US011084312B2

(12) United States Patent
Dhillon et al.

(10) Patent No.: US 11,084,312 B2
(45) Date of Patent: Aug. 10, 2021

(54) SECURITY SHEET

(71) Applicant: De La Rue International Limited, Basingstoke (GB)

(72) Inventors: Baljeet Dhillon, Basingstoke (GB); Matthew Sugdon, Basingstoke (GB); Shireen Bobat, Basingstoke (GB)

(73) Assignee: DE LA RUE INTERNATIONAL LIMITED, Basingstoke (GB)

( * ) Notice: Subject to any disclaimer, the term of this patent is extended or adjusted under 35 U.S.C. 154(b) by 0 days.

(21) Appl. No.: 16/977,259

(22) PCT Filed: Mar. 1, 2019

(86) PCT No.: PCT/GB2019/050574
§ 371 (c)(1),
(2) Date: Sep. 1, 2020

(87) PCT Pub. No.: WO2019/166819
PCT Pub. Date: Sep. 6, 2019

(65) Prior Publication Data

US 2021/0039418 A1 Feb. 11, 2021

(30) Foreign Application Priority Data

Mar. 2, 2018 (GB) ..... 1803449
Jun. 28, 2018 (GB) ..... 1810627

(51) Int. Cl.
*B42D 13/00* (2006.01)
*B42D 25/36* (2014.01)
(Continued)

(52) U.S. Cl.
CPC ..... *B42D 13/00* (2013.01); *B42D 25/36* (2014.10); *B42D 25/23* (2014.10); *B42D 25/24* (2014.10); *B42D 25/455* (2014.10); *B42D 25/46* (2014.10)

(58) Field of Classification Search
CPC ..... B42D 13/00; B42D 25/36; B42D 25/23; B42D 25/24; B42D 25/455; B42D 25/46
(Continued)

(56) References Cited

U.S. PATENT DOCUMENTS

2016/0144651 A1 5/2016 Springmann
2018/0304666 A1* 10/2018 Brunet ..... G06K 19/07749

FOREIGN PATENT DOCUMENTS

DE 102010054480 A1 6/2012
DE 102015102304 A1 8/2016
(Continued)

OTHER PUBLICATIONS

International Search Report and Written Opinion dated Apr. 11, 2019 for International Patent Application No. PCT/GB2019/050574, 15 pages.
(Continued)

*Primary Examiner* — Justin V Lewis
(74) *Attorney, Agent, or Firm* — Morgan, Lewis & Bockius LLP

(57) ABSTRACT

The present disclosure is directed towards a security sheet (11) for displaying data (16). The security sheet (11) comprises a data sheet (15) for displaying data (16) and an attachment layer (17). The attachment layer (17) comprises a plurality of tabs (25) extending from an attachment portion (26) for attaching the data sheet (15) into a security document (10). The plurality of tabs (25) are attached to the data sheet (15) such that the attachment layer (17) is attached to and extends from the data sheet (15). The attachment layer (17) can comprise a textile.

20 Claims, 19 Drawing Sheets

(51) Int. Cl.

| | |
|---|---|
| ***B42D 25/23*** | (2014.01) |
| ***B42D 25/24*** | (2014.01) |
| ***B42D 25/455*** | (2014.01) |
| ***B42D 25/46*** | (2014.01) |

(58) Field of Classification Search
USPC ..... 283/72, 74, 75, 94, 98
See application file for complete search history.

(56) References Cited

FOREIGN PATENT DOCUMENTS

| | | | | |
|---|---|---|---|---|
| DE | 102015015563 | A1 | 6/2017 | |
| EP | 1008459 | A1 | 9/2002 | |
| EP | 1592565 | A1 | 12/2004 | |
| EP | 1592565 | B1 | 9/2005 | |
| EP | 1502765 | B2 | 8/2012 | |
| EP | 3275683 | A1 | 1/2018 | |
| GB | 2548645 | A | 9/2017 | |
| WO | 2004110780 | A1 | 12/2004 | |
| WO | 2017060684 | A1 | 4/2014 | |
| WO | 2016124281 | A1 | 8/2016 | |
| WO | 2016131641 | A4 | 8/2016 | |
| WO | WO-2017013311 | A1 * | 1/2017 | ..... G06K 19/07773 |
| WO | 2017060688 | A1 | 4/2017 | |

OTHER PUBLICATIONS

Combined Search and Examination Report under Sections 17 & 18(3) dated Sep. 3, 2018 for GB1803449.6, 8 pages.
Examination Report dated Dec. 3, 2020, for GB Patent Application No. 1803449.6, 3 pages.

* cited by examiner

SECURITY SHEET

CROSS REFERENCE TO RELATED APPLICATIONS

This application is a U.S. National Stage Application of International Application No. PCT/GB2019/050574 filed on Mar. 1, 2019, which claims the benefit of GB Patent Application No. 1810627.8 filed Jun. 28, 2018, and GB Patent Application No. 1803449.6 filed Mar. 2, 2018, each of which is incorporated by reference herein in its entirety.

TECHNICAL FIELD

The present invention is directed towards a security sheet for displaying data. The present invention is further directed towards a security document comprising such a security sheet and a method of manufacturing such security sheets and documents.

BACKGROUND

Security documents and booklets, such as passports, passbooks, identification documents, certificates, licences, cheque books and the like, commonly comprise one or more security sheets on which information is provided. A passport booklet typically comprises a cover, a plurality of internal visa pages and at least one security sheet displaying the personal data of the passport holder. Typically the visa pages are made from paper and are sewn together along a stitch line coincident with the fold line of the document. The security sheet may be formed from a plastic, typically polycarbonate, and during its manufacture a number of thin plastic layers are laid over one another and laminated together, thereby forming a thicker plastic body. As this plastic body is typically rigid and unable to bend without plastic deformation it is generally not attached at the stitch line such that the booklet can still bend at the fold line.

The plastic body may therefore be attached about the fold line using a flexible layer attached to and extending from the plastic body. Usually steps are taken to ensure that the plastic body is resistant to delamination by counterfeiters or forgers attempting to adapt the personal data. Furthermore, the attachments of the flexible layer to the plastic body and about the fold line need to be sufficiently durable and resistant to delamination to endure for the lifetime of the security booklet, which is often 10 years or more in the case of passports.

EP-B1-1592565 proposes a two zone data sheet. In the first zone a flexible and bending resistant attachment portion protrudes as a strip into a data portion. In the second zone a uniform data region contains the personal data and improves resistance to delamination by being substantially homogenous or uniform. However, the strip of the attachment portion is small and forms distinct boundaries within the data portion and at the edge of the data portion where the attachment portion enters the data portion. As a result, the first zone is less resistant to delamination and presents a clear boundary at the data portion edge for a counterfeiter to insert a sharp implement for an attempted delamination. In effect, a more delamination-resistant uniform data region is achieved at the expense of a less delamination-resistant attachment between the flexible layer and data portion.

EP-B2-1502765 discloses a data page having a flexible textile layer attached to a data carrier by forming welding points of the data carrier through mesh openings of the textile during lamination. The use of a textile improves the durability of the connection between the flexible layer and the stitch line. However, the welding points form a very small area of attachment between the adjacent layers and the rest of the textile forms a distinct boundary. Therefore, the data page is less resistant to delamination.

SUMMARY

Objects of the present invention include addressing these problems. Objects of the present invention include providing an improved security sheet with increased resistance to delamination by a forger and improved durability. A further object is to provide a strong and durable attachment between the security sheet and the rest of a security document. Further objects include providing an improved method of manufacture of such a security sheet and a security document comprising such a security sheet.

The present invention therefore provides a security sheet comprising: a data sheet for displaying data; and an attachment layer comprising a plurality of tabs extending from an attachment portion for attaching the data sheet into a security document, wherein the plurality of tabs are attached to the data sheet such that the attachment layer is attached to and extends from the data sheet.

Surprisingly it has been found that the tabs provide a very strong and durable connection between the attachment and data sheets. Rather than having welding points through mesh openings to lock the attachment layer to the data sheet as in EP-B2-1502765, the increased surface area of contact between the plurality of tabs and data sheet can provide a strong frictional force against attempted removal of the attachment layer from the data sheet.

Preferably the plurality of tabs are attached to the data sheet by being at least partially embedded in the data sheet. As the material of the data sheet is integrated with the tabs, the security sheet can substantially resist delamination even in the region where the attachment layer overlaps the data sheet and, for example, around the personal data. This is particularly contrary to the teaching of EP-B1-1592565, which requires the uniform data region in order to avoid delamination.

Preferably at least one spacing separates at least two adjacent tabs of the plurality of tabs. Material of the data sheet preferably at least partially fills the at least one spacing such that the at least two adjacent tabs are at least partially embedded in the data sheet. Thus it is very difficult to remove the plurality of tabs from the data sheet without causing substantial and identifiable damage to the material of the data sheet.

The data sheet may be formed from at least a plurality of body layers and at least one tab of the plurality of tabs is attached between two adjacent body layers, which may be at least partially attached to one another such as by being laminated, adhered, pressed into, fused and/or welded to one another (i.e. directly in contact with one another at least in at least one spacing between adjacent tabs). As a result, the two adjacent body layers overlie the at least one tab and are attached or fused to one another adjacent to the at least one tab and/or between adjacent tabs. In particular, the adjacent body layers are attached to one another through at least one spacing between at least two adjacent tabs. At least one tab of the plurality of tabs may be attached at or adjacent to an outer surface of the data sheet. The at least one tab may be at least partially attached to, such as by being laminated into, adhered to, pressed into, fused into or welded to, the body layer forming the outer surface. The body layer thus may overlie the at least one tab and may be located adjacent to the at least one tab and/or between adjacent tabs.

The security sheet preferably comprises data elements located in or on the data sheet. The plurality of tabs may at least partially overlap the data elements. The data elements may comprise laser markings and/or printed ink and preferably comprise personal data relating to a holder of the security sheet. A counterfeiter or forger will therefore struggle to remove the plurality of tabs without affecting at least some of the data and struggle to alter the data without affecting the plurality of tabs. A counterfeit or forged document is therefore also more easily identified.

Preferably the attachment layer comprises a textile. Preferably the attachment portion comprises a plurality of warps intersecting a plurality of wefts and the plurality of tabs comprises portions of the plurality of warps extending from the plurality of wefts or portions of the plurality of wefts extending from the plurality of warps. As a result, the attachment portion is sufficiently flexible, resistant to plastic deformation and durable. However, as there is no mesh of the textile in the data sheet (as taught by EP-B2-1502765) the boundary between the wefts and data sheet is smaller and therefore more resistant to delamination. The plurality of tabs may comprise undulations in the data sheet.

In an alternative embodiment the attachment layer comprises at least one film layer. Preferably the attachment portion comprises an elongate body of the at least one film layer and/or the plurality of tabs comprise the at least one film layer and extend from the elongate body. At least one tab of the plurality of tabs may comprise at least one aperture, taper outwardly from the attachment portion, comprise at least one indentation in at least one edge, comprise a strip of the at least one film layer extending from the attachment portion and/or comprise at least one barb. The at least one film layer can be easily integrated into the data sheet during lamination and can have a suitable shape for further improving the connection between the data sheet and attachment portion.

The present invention also provides a method as set out in claim 32. The method may further comprise attaching the attachment layer to the at least one body layer by laminating, adhering, pressing, fusing welding and/or otherwise attaching the at least one body layer such that the plurality of tabs are at least partially embedded in the at least one body layer. The plurality of tabs may be at least partially located between adjacent body layers of the at least one body layer prior to attachment. The adjacent body layers may be attached, such as by lamination, adhesion, pressing, fusing and/or welding, to one another through at least one spacing between at least two adjacent tabs of the plurality of tabs. The plurality of tabs may be located to at least partially overlie at least one outer surface of the at least one body layer. The or at least one of the plurality of tabs may be laminated into, welded into, adhered to or otherwise attached to the at least one outer surface.

The method of forming the attachment layer may comprise providing a textile comprising warps and wefts and removing a portion of the warps from the textile to expose portions of the wefts, the attachment portion comprising a plurality of wefts intersecting the remaining plurality of warps and the plurality of tabs comprising the exposed portions of the plurality of wefts. At least one tab of the plurality of tabs may be at least partially exposed at one or more edges of the data sheet and the one or more edges may be sealed to cover the at least one exposed tab.

The present invention also provides a security document according to claim 29, a laminar structure according to claim 30 and an attachment layer according to claim 37.

The present invention further provides a security booklet in accordance with claim 38. The present invention further provides a security booklet foldable about a fold comprising: a data sheet for displaying data; an inner booklet comprising a plurality of leaves foldable about the fold; an attachment layer attached to the data sheet and foldable about the fold around the inner booklet, the attachment layer comprising adjacent regions on either side of a fold region extending along and across the fold, wherein the attachment layer comprises a textile, the adjacent regions comprise at least two adjacent warps interlaced with a plurality of wefts and the fold region comprises the plurality of wefts extending between the at least two adjacent warps, wherein the fold region is at least 0.5 mm wide across the fold. The aforementioned security booklets may comprise any of the features of the appended claims.

BRIEF DESCRIPTION OF THE DRAWINGS

By way of example only, embodiments of a security sheet, a security document and a method of manufacture in accordance with the present invention are now described with reference to, and as shown in, the accompanying drawings, in which.

DETAILED DESCRIPTION

Figure 1:
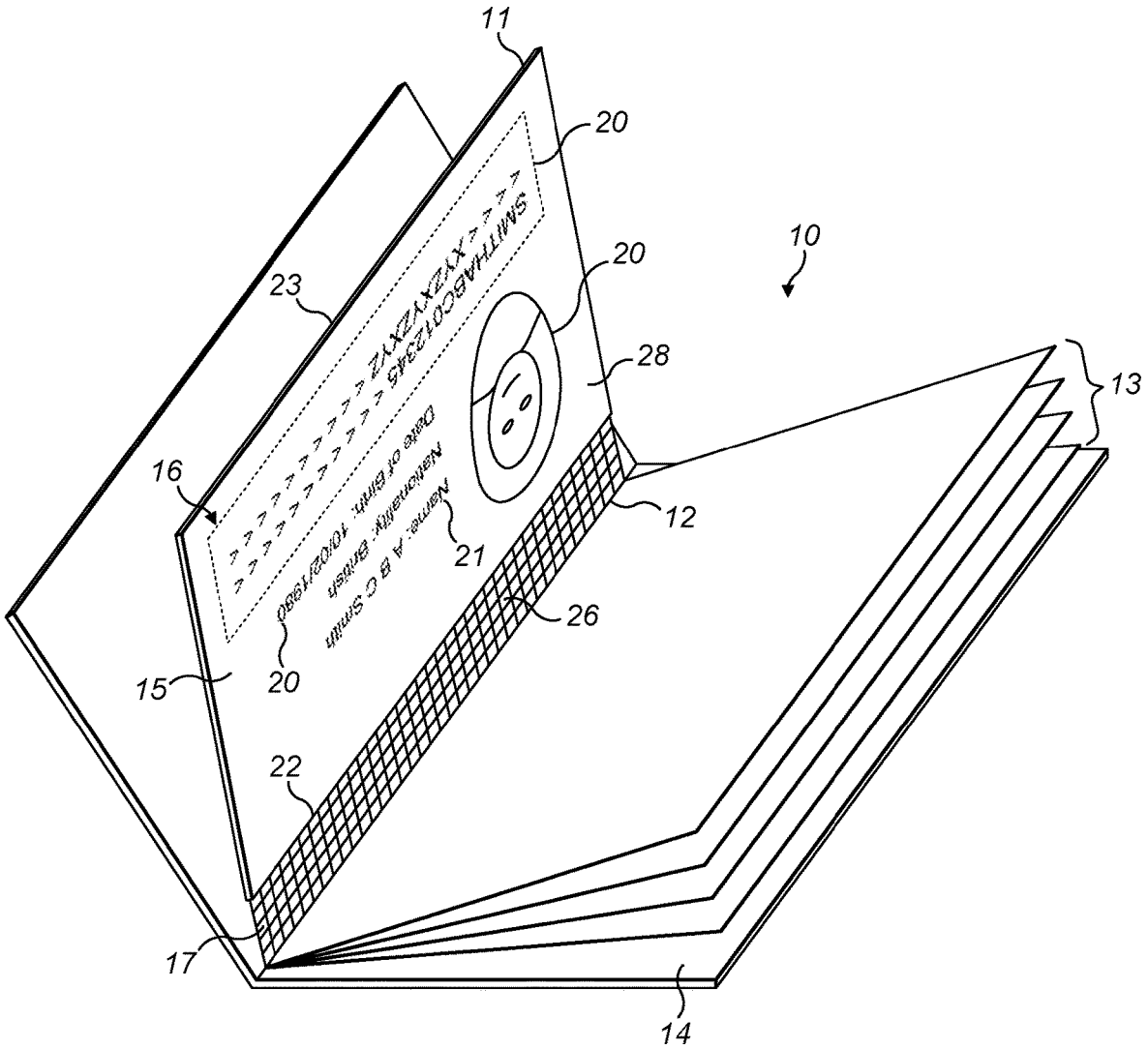
FIG. 1 is a perspective view of a security document, particularly a passport, according to the present invention in an open configuration.
Figure 2:
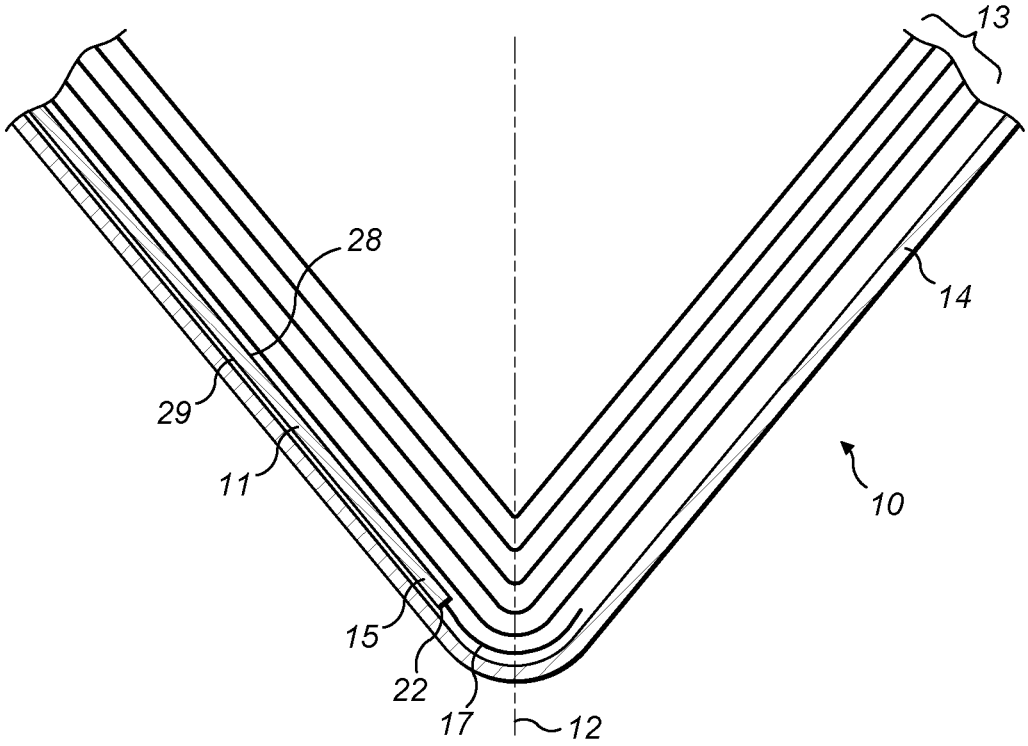
FIG. 2 is a schematic cross-sectional side elevation of a fold line area of the security document of FIG. 1 in an exploded configuration.

FIGS. 1 and 2 illustrate a security document 10 in accordance with the present invention. The security document 10 may be of any suitable type, but preferably comprise a security booklet, such as a passport as illustrated, a passbook, an identification document, a certificate, a licence, a cheque book or the like. The security document 10 comprises a security sheet 11, in this case a data page, foldable about and preferably attached along a fold line 12 to a plurality of leaves 13. The plurality of leaves 13 preferably comprise a fibrous substrate, comprising for example paper and/or cotton, may form visa pages and may form an inner booklet of the security document 10. The security document 10 also comprises a cover 14, which may also be foldable about and attached to the fold line 12 and/or may be adhered to an outer leaf (not shown) located on the outside of the leaves 13 and security sheet 11. The attachment is preferably by means of stitching through the security sheet 11, leaves 13 and/or cover 14 at the fold line 12, although other attachment means such as adhesion may be used. The stitch or other attachment line may be offset from the fold line 12.

The security sheet 11 comprises a data sheet 15, which preferably comprise plastic, for displaying data 16 and an attachment layer 17 attached to the data sheet 15. The data sheet 15 extends across a width from an inner edge 22, located proximate the fold line 12, to an outer edge 23, distal to the fold line 12 and at the edge of the security document 10. The security sheet 11 is preferably formed by the lamination of a laminar structure 19, embodiments of which are illustrated in FIGS. 4A, 5A, 6A, 7A, 13A and 17A, comprising at least one body layer 18 for forming the data sheet 15 and the attachment layer 17. The data sheet 15 preferably formed by the lamination together of a plurality of body layers 18. During lamination heat and/or pressure are applied to fuse the plurality of body layers 18 together. The lamination may be performed using any suitable method and may be a substantially in-line method, similar to that of WO-A-2017/060684 and WO-A-2017/060688, in which a plurality of security sheets 11 are formed continuously. In addition, the connection of the plurality of body layers 18 may be by adhesion, welding and/or any other suitable method.

The data sheet 15 extends across a thickness between substantially planar first and second outer surfaces 28, 29. Preferably the data sheet 15 is substantially rigid or at least semi-rigid. The data sheet 15 and at least one body layer 18 may comprise at least one of a thermoplastic polymer, polycarbonate, polybutylene terephthalate, polyester, polyethylene, polypropylene, polyvinyl chloride, a co-polymer comprised of any of the previous thermoplastic polymers, a fibrous substrate and the like. Each body layer 18 may be between approximately 50 μm thick and approximately 1000 μm thick. The thickness of the data sheet 15 is preferably at least approximately 150 μm and may be between approximately 300 μm and approximately 1000 μm thick.

The data 16 preferably comprises a plurality of data elements, each forming an alphanumeric character, symbol, logo, indicia or the like. The data 16 preferably comprises personal or variable data 20, which specifically relates to the holder of the security sheet 11 and is different between a plurality of security documents 10, and fixed or non-variable data 21, which is typically the same across a plurality of security documents 10 and security sheets 11. The data 16 may be incorporated into the data sheet 15 before and/or after lamination in any suitable manner, for example by printing ink or laser marking. At least one body layer 18 may be laser markable, such as by containing suitable additives, so that the data sheet 15 can be laser marked.

In the present invention, and as best illustrated in FIGS. 3 to 19, the attachment layer 17 comprises a plurality of tabs 25 extending from an attachment portion 26. The attachment portion 26 is located at least partially, preferably entirely, outside of the data sheet 15 and is attached in the security document 10, preferably along the fold line 12 as shown. The attachment portion 26 may comprise a substantially elongate sheet or body as illustrated. Stitching preferably extends through the attachment portion 26 and along the fold line 12 to attach it to the further leaves 13. The attachment portion 26 is preferably flexible and can fold around the fold line 12 such that it does not impair the opening and closing of the security document 10. The attachment portion 26 is preferably substantially resistant to plastic deformation during folding such that it is sufficiently durable to withstand repeated folding over the lifetime of the security document 10 without failure. The attachment portion 26 is preferably substantially tear resistant, particularly at the fold line 12 and around any stitching passing through it. As discussed in further detail below, the attachment portion 26 may therefore comprise a textile, a woven or nonwoven textile, threads, yarns, strips, at least one film layer 40 and/or the like. The attachment layer 17 may comprise a plurality of layers bonded or otherwise laminated together.

The tabs 25 are at least partially located in or on and attached to the data sheet 15 such that the attachment layer 17 extends from the data sheet 15 and preferably from the inner edge 22. Each tab 25 comprises a substantially elongate body attached, integrated or otherwise connected to the attachment portion 26. At least one spacing 27 separates at least two adjacent tabs 25 of the plurality of tabs 25 and each tab 25 may not be connected to another tab 25 other than by the attachment portion 26.

Figure 4A:
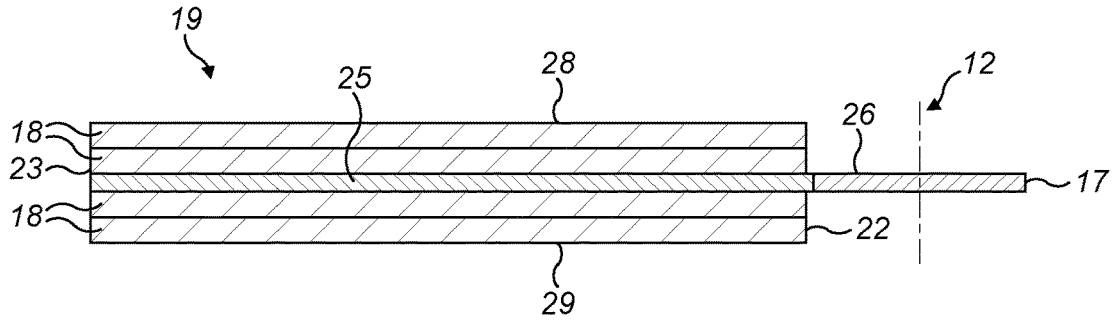
FIGS. 4A, 5A, 6A and 7A are each cross-sectional side elevations of embodiments of a laminar structure according to the present invention.
Figure 4B:
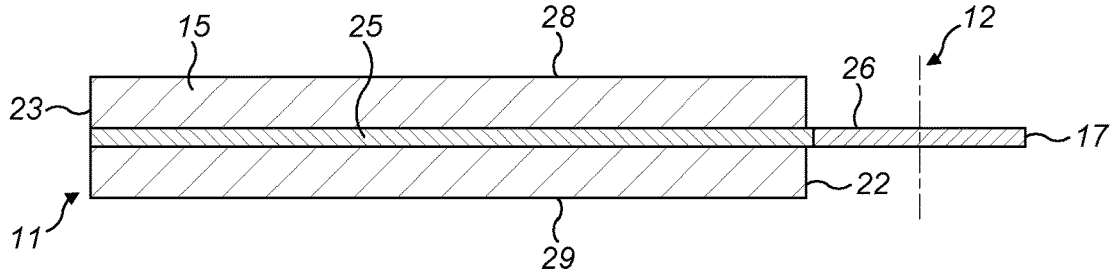
FIGS. 4B, 5B, 6B and 7B are each cross-sectional side elevations of embodiments of a security sheet formed from the laminar structures of FIGS. 4A, 5A, 6A and 7A respectively.
Figure 5A:
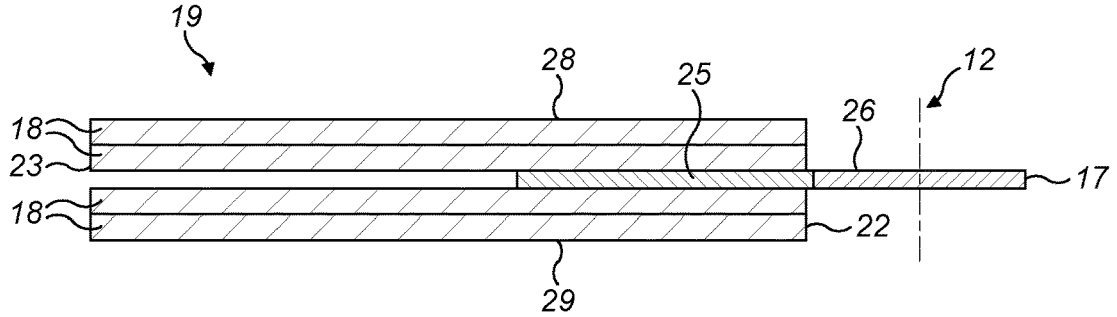
Figure 5B:
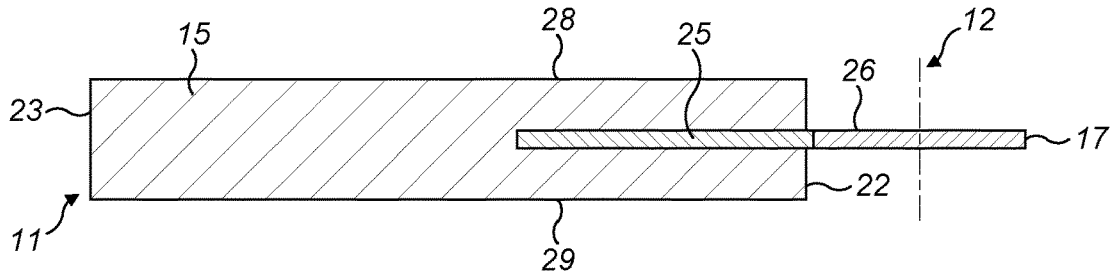

The tabs 25 are attached to the data sheet 15 by lamination, preferably during the lamination of the plurality of body layers 18, and/or welding to the at least one body layer 18 or laminated data sheet 15. FIGS. 4A and 5A illustrate particularly preferred embodiments of the laminar structure 19 in which the tabs 25 are at least partially located between two adjacent body layers 18 prior to lamination. The laminar structure 19 is laminated to form the security sheet 11, as shown in FIGS. 4B and 5B, in which the body layers 18 are fused to one another to form the data sheet 15 and the tabs 25 are located substantially within the data sheet 15. During lamination the material of two body layers 18 adjacent to and overlying the adjacent tabs 25 flows or is pressed through the at least one spacing 27. As a result, material of the data sheet 15 at least partially fills at least one spacing 27 between at least two adjacent tabs 25, which are therefore embedded in the data sheet 15. Preferably every spacing 27 between adjacent tabs 25 is filled with material of the data sheet 15 to ensure a strong connection.

Figure 6A:
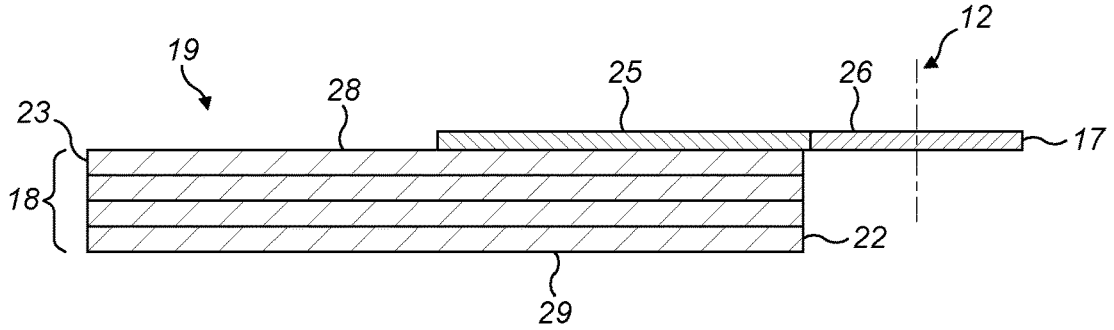
Figure 6B:
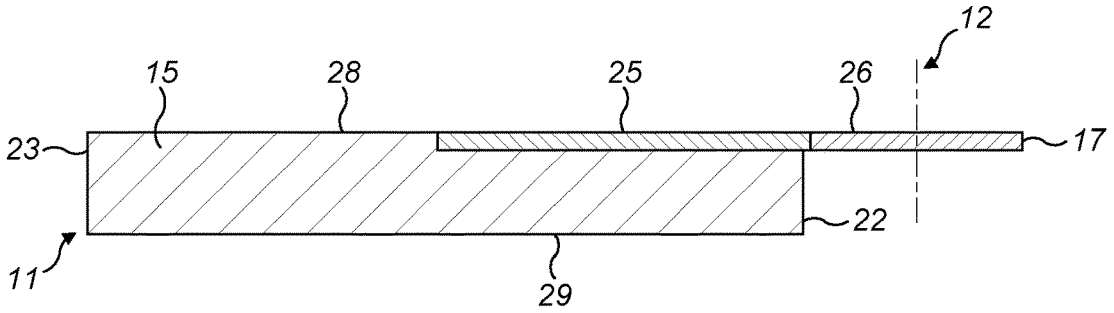
Figure 7A:
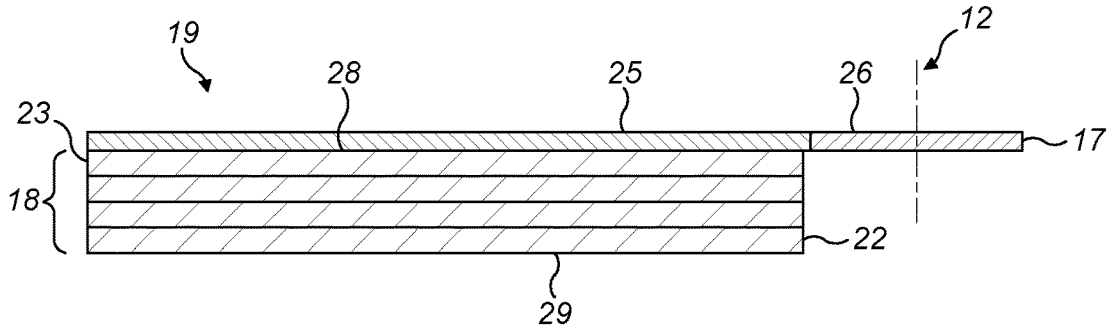
Figure 7B:
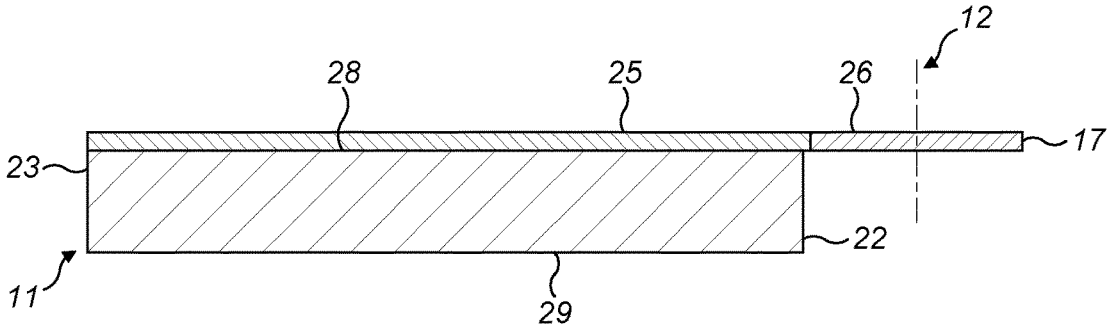
Figure 17A:
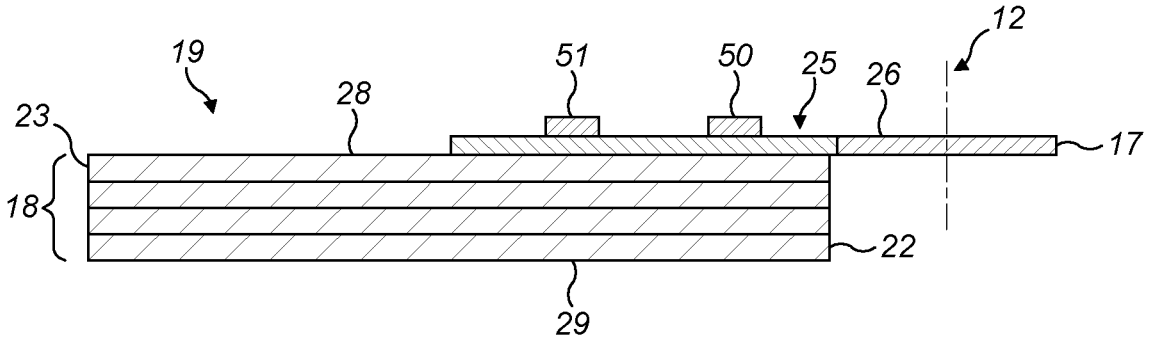
FIG. 17A is a cross-sectional side elevation of a further embodiment of a laminar structure for forming the security sheet of FIG. 16.
Figure 17B:
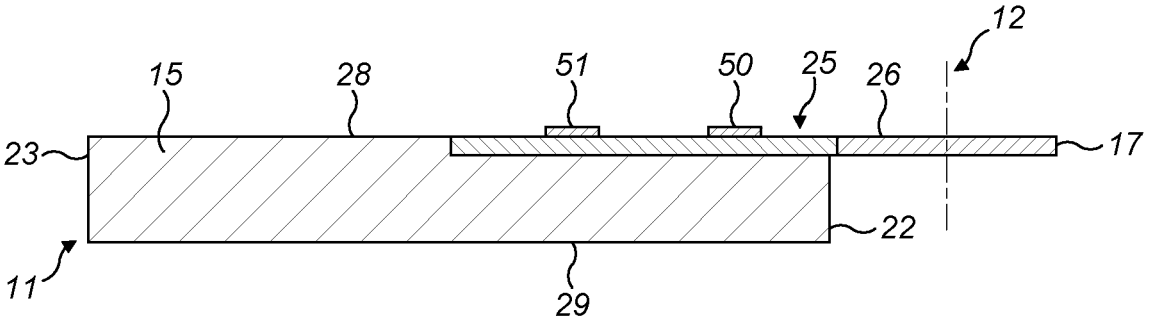
FIG. 17B is a cross-sectional side elevation of the security sheet of FIG. 16.

FIGS. 6A, 7A and 17A illustrate further embodiments of the laminar structure 19 in which the tabs 25 are located on the first or second outer surface 28, 29 of the at least one body layer 18 and data sheet 15. In the data sheet 15, as illustrated in FIGS. 6B, 7B and 17B, the tabs 25 are at least partially attached at or adjacent to an outer surface of the data sheet 15. The tabs 25 may be laminated and pressed into the first or second outer surface 28, 29 during lamination of the plurality of body layers 18. Alternatively, before or after lamination of the plurality of body layers 18, the tabs 25 may be welded into the first or second outer surface 28, 29. In each method the material of the at least one body layer 18 flows or is pressed through the at least one spacing 27 to form the connection such that the tabs 25 are at least partially embedded in the data sheet 15. The lamination or welding preferably presses the tabs 25 into the first or second outer surface 28, 29 sufficiently deeply that substantially all of the tabs 25 are not exposed and are covered by the material of the at least one body layer 18.

The tabs 25 are therefore firmly connected to the at least one body layer 18 by a frictional force applying a resistance to the attempted removal of the attachment layer 17 from the data sheet 15. The tabs 25 may be connected to the data sheet 15 only by friction and, for example, not by a mechanical, fusing, chemical or other locking mechanism. Preferably the tabs 25 comprise a different material to the surrounding material of the data sheet 15 such that a discrete boundary or frictional contact surface is formed between them. The tabs 25 may thus comprise a material of a higher melting point to that of adjacent body layers 18 and, during lamination or welding, the tabs 25 do not melt or fuse to the body layers 18. However, alternatively or in addition, the tabs 25 may be at least partially bonded to the data sheet 15 by fusing, adhesion and/or the like with the body layers 18 to further improve the strength of the connection.

Preferably the contact surface area is relatively large to improve the strength of the connection. Therefore, as shown in FIGS. 3 and 8 to 16, preferably each of the plurality of tabs 25 is separated from an adjacent tab 25 by a spacing 27. However, unavoidably during manufacture or by design one or more tabs 25 may overlap one or more adjacent tabs 25. Therefore, preferably at least 50%, more preferably at least 75%, more preferably at least 90% or more preferably at least 95% of the plurality of tabs 25 are separated from their adjacent tab 25 by a spacing 27. Further preferably the attachment layer 17 comprises at least five tabs 25, more preferably at least ten tabs 25, more preferably at least twenty tabs 25 and, yet more preferably, at least fifty tabs 25.

The tabs 25 may extend substantially entirely across the data sheet 15, as illustrated in FIGS. 4A, 4B, 7A, 7B, 8, 13A, 13B and 15. However, the tabs 25 may extend only partially across the data sheet 15, as illustrated in FIGS. 3, 5A, 5B, 6A, 6B, 10, 11, 12 and 14 to 19. The tabs 25 and spacings 27 may extend from the inner edge 22 of the data sheet 15 across at least 25%, at least 50%, at least 75% or at least 90% of the data sheet 15 to the outer edge 23 of the data sheet 15 (i.e. across the data sheet 15 in a direction substantially perpendicular to the fold line 12).

The size of the at least one spacing 27 is selected to enable a suitably large volume of material of the data sheet 15 to flow, bond and/or fuse between the tabs 25 to provide resistance to delamination of the data sheet 15. The average width of at least one spacing 27 may be at least or greater than the average width of the tab(s) 25 adjacent to the at least one spacing 27. Alternatively, the width, average width or maximum width of at least one spacing 27 may be at least or greater than the maximum width of the tab(s) 25 adjacent to the at least one spacing 27. The width of a spacing 27 may be the distance between adjacent tabs 25 in a direction substantially parallel to the fold line 12 and/or the width of a tab 25 may be the distance between the opposing outer edges of a tab 25 in a direction substantially parallel to the fold line 12. The maximum and/or average width of the at least one spacing 27 is preferably at least approximately 0.5 mm, more preferably at least approximately 1 mm, more preferably at least approximately 2 mm, and yet more preferably at least approximately 5 mm. The width of the spacings 27 may also vary across the attachment layer 17.

Various arrangements of the attachment layer 17 fall within the scope of the present invention. In FIGS. 3, 8, 16, 18 and 19 the attachment layer 17 at least partially comprises a textile comprising wefts 30 and warps 31. The attachment portion 26 comprises a textile, which may be woven and/or knitted, having interlaced wefts 30 and warps 31. In particular, the attachment portion 26 comprises at least two of the warps 31 of the textile interlacing and/or overlapping at least portions of at least two of the wefts 30 of the textile. The warps 31 may extend substantially parallel to one another, the fold line 12 and/or the inner edge 22 of the data sheet 15. The wefts 30 preferably extend substantially parallel to one another and/or are preferably substantially perpendicular to the warps 31, inner edge 22 of the data sheet 15 and/or the fold line 12. It will be appreciated that the wefts 30 may be termed as the warps 31, depending upon orientation of the attachment layer 17, and that the terms used herein are merely used for the sake of nomenclature. The tabs 25 also comprise portions of the wefts 30 extending out of the textile of the attachment portion 26. In particular, the wefts 30 comprise tab wefts 61 and the tabs 25 comprise at least portions of the tab wefts 61. Each tab 25 may comprise a single weft 30. In particular, the tabs 25 comprise the portions of the wefts 30 extending from the distal warp 63, which is the warp 31 of the attachment portion 26 distal to the fold line 12, and/or proximate the inner edge 22 of the data sheet 15.

In FIGS. 3, 16, 18 and 19 the textile comprises threads or yarns forming the wefts 30 and warps 31. Threads and yarns are used in the present disclosure interchangeably and refer to a long, thin strand of material for forming the textile by weaving, knitting, sewing or other interlacing method. For example, the yarns may comprise at least one of cotton, polyamide, polyester, viscose, glass, polypropylene, polyaramid, polyurethane, nylon, bonded nylon, polycotton and/or other suitable fibres. Each yarn may be substantially circular, trilobal, fibrillated, grooved, dog bone or multiform in cross section. Each yarn may be single or one-ply (i.e. single strands of fibres twisted together or single filament strands), multi-ply (i.e. a plurality of single yarns twisted together) or cord yarns (i.e. a plurality of multi-ply yarns twisted together). Each yarn may have a diameter in the range of from approximately 26 microns up to approximately 300 microns. The spacings 27 between the yarns may have a width in the range of from approximately 18 microns up to approximately 200 microns. The threaded textile, preferably woven threaded textile, of the attachment portion 26 is particularly suitable as it is very flexible and resistant to plastic deformation. As the weft yarns 30 form a large number of tabs 25, the contact surface area between the tabs 25 and data sheet 15 is particularly high.

Figure 8:
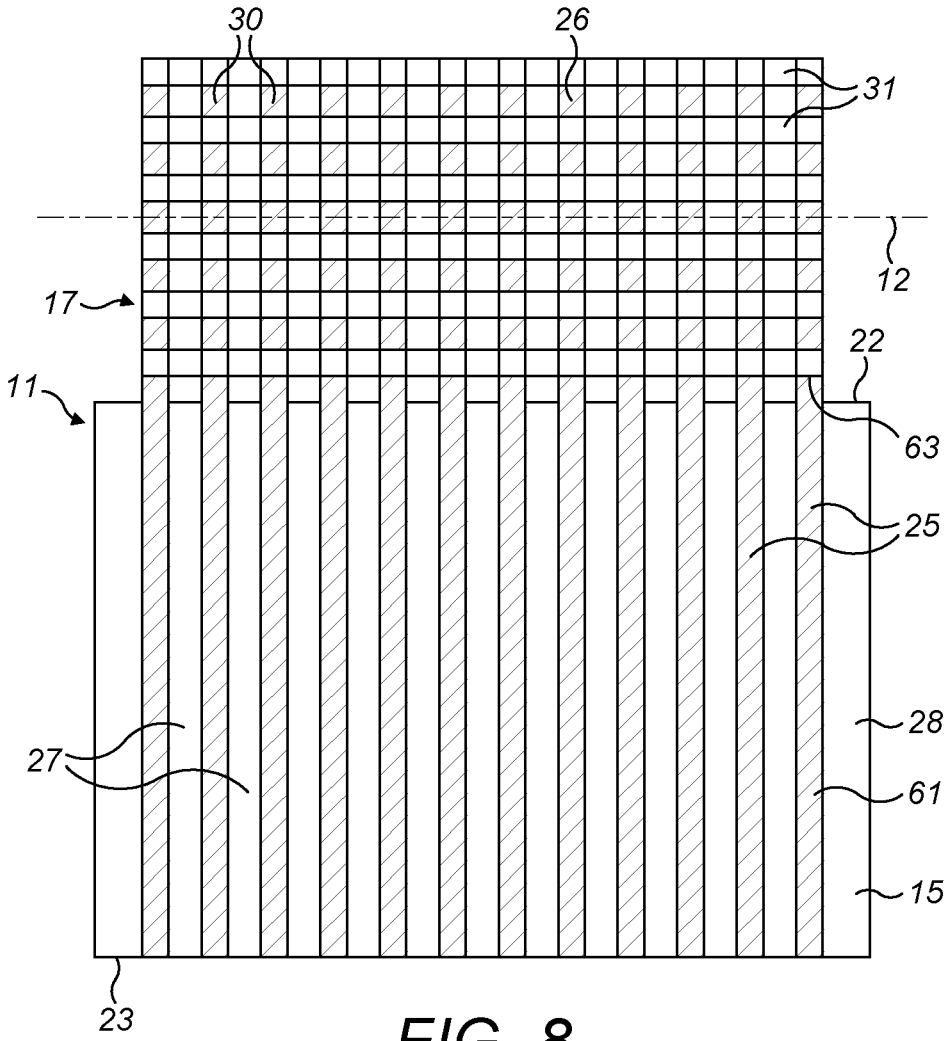
FIG. 8 is a schematic plan view of a further embodiment of a security sheet according to the present invention.

In FIG. 8 the textile comprises strips forming the wefts 30 and warps 31. The strips may comprise, for example, polyester, polyamide, cotton, polyamide, polyester, viscose, glass, polypropylene, polyaramid, polyurethane, nylon and/or the like. The width of the strips is preferably in the range of from approximately 0.5 mm to approximately 10 mm.

Figure 9:
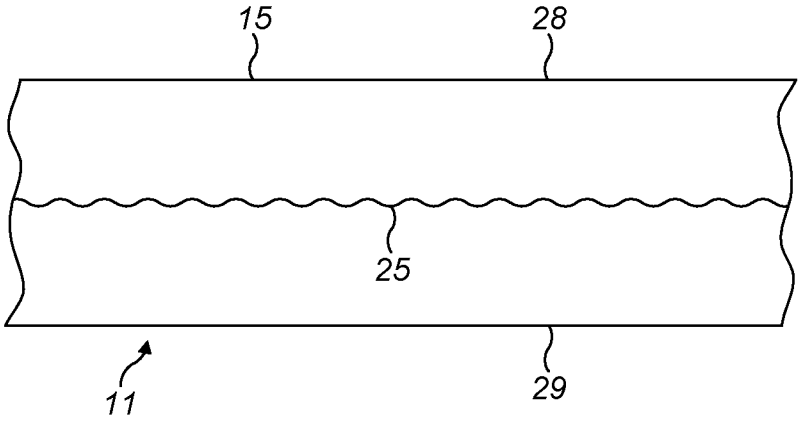
FIG. 9 is a cross-sectional side elevation of parts of a particular embodiment of the security sheet of FIG. 3.
Figure 10:
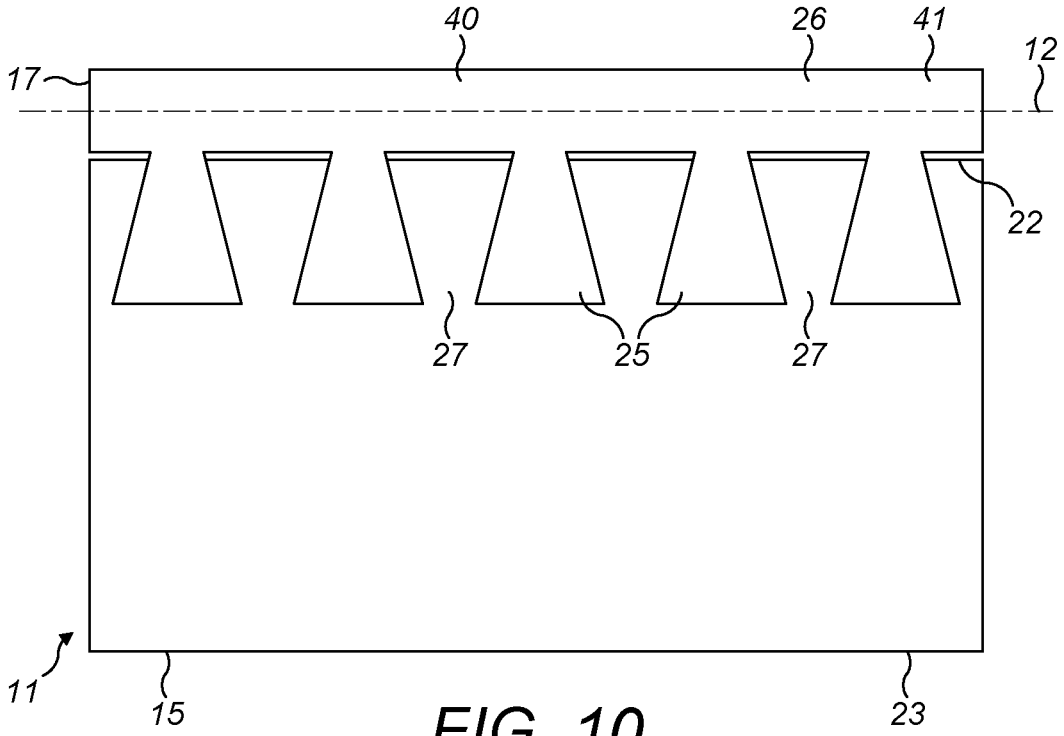
FIGS. 10 to 12 are each schematic plan views of further embodiments of a security sheet according to the present invention.

The attachment layer 17 may be formed by weaving the warp yarns 31 through just part of the weft yarns 30. However, the method of forming the attachment layer 17 may comprise removing part of the warp yarns 31 from a fully woven textile, thereby exposing the portions of the weft yarns 30 for forming the tabs 25 (or alternatively removing part of the weft yarns from a fully woven textile thereby exposing the portions of the warp yarns). As illustrated in FIG. 9, which shows a cross-section of part of the data sheet 15 after lamination, the exposed portions of the weft yarns 30 therefore have undulations where they were pressed by the warp yarns 31 originally in the woven textile. These undulations form a sinusoidal path through the thickness of the data sheet 15, thereby increasing resistance to removal of the attachment layer 17. Alternatively, the woven textile may be formed such that at least part of the warp yarns 31 are soluble in a liquid, such as water, and these warp yarns 31 are removed by dipping the woven textile in the liquid.

Figure 3:
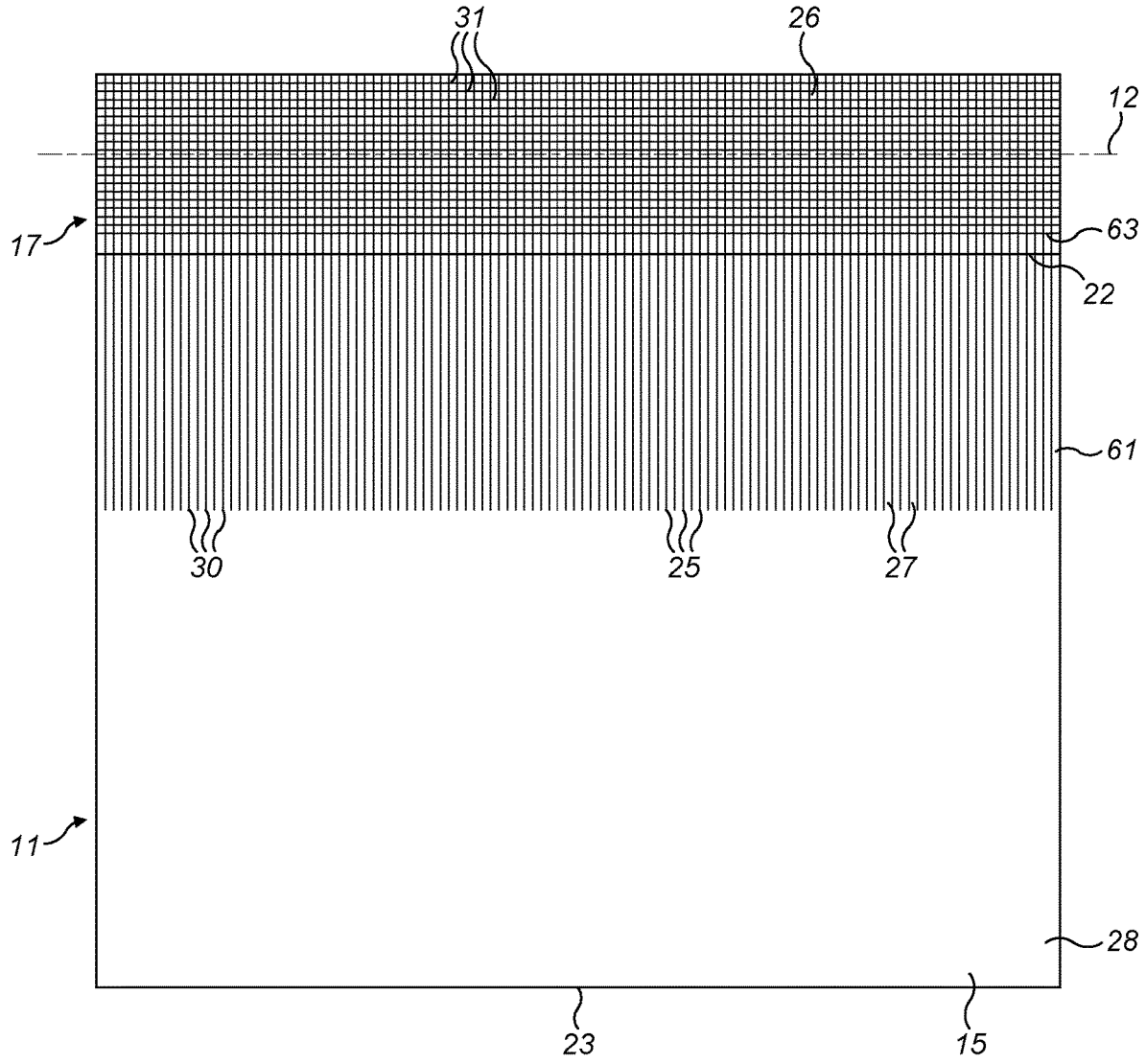
FIG. 3 is a schematic plan view of an embodiment of a security sheet according to the present invention.
Figure 16:
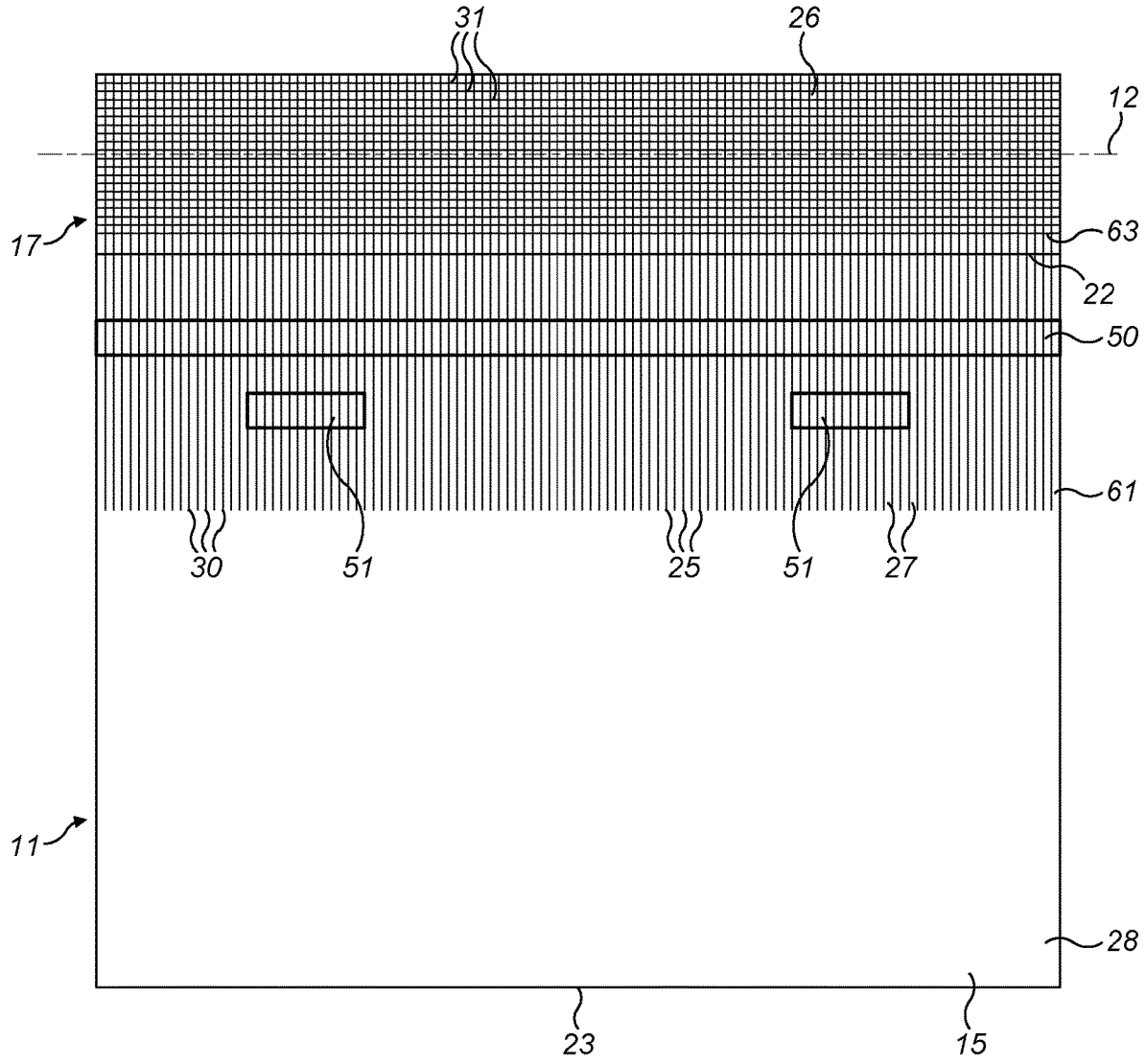
FIG. 16 is a schematic plan view of a further embodiment of a security sheet according to the present invention.

In FIGS. 3, 8 and 16 the attachment portion 26 comprises all of the warps 31 of the textile interlaced with all of the wefts 30 of the textile. The tabs 25 comprise portions of all of the wefts 30 of the textile such that every weft 30 is a tab weft 61. As a result, the attachment portion 26 comprises a plurality of warps 31 intersecting a plurality of wefts 30 and the plurality of tabs 25 comprise portions of the plurality of wefts 30 extending from the plurality of warps 31.

Figure 18:
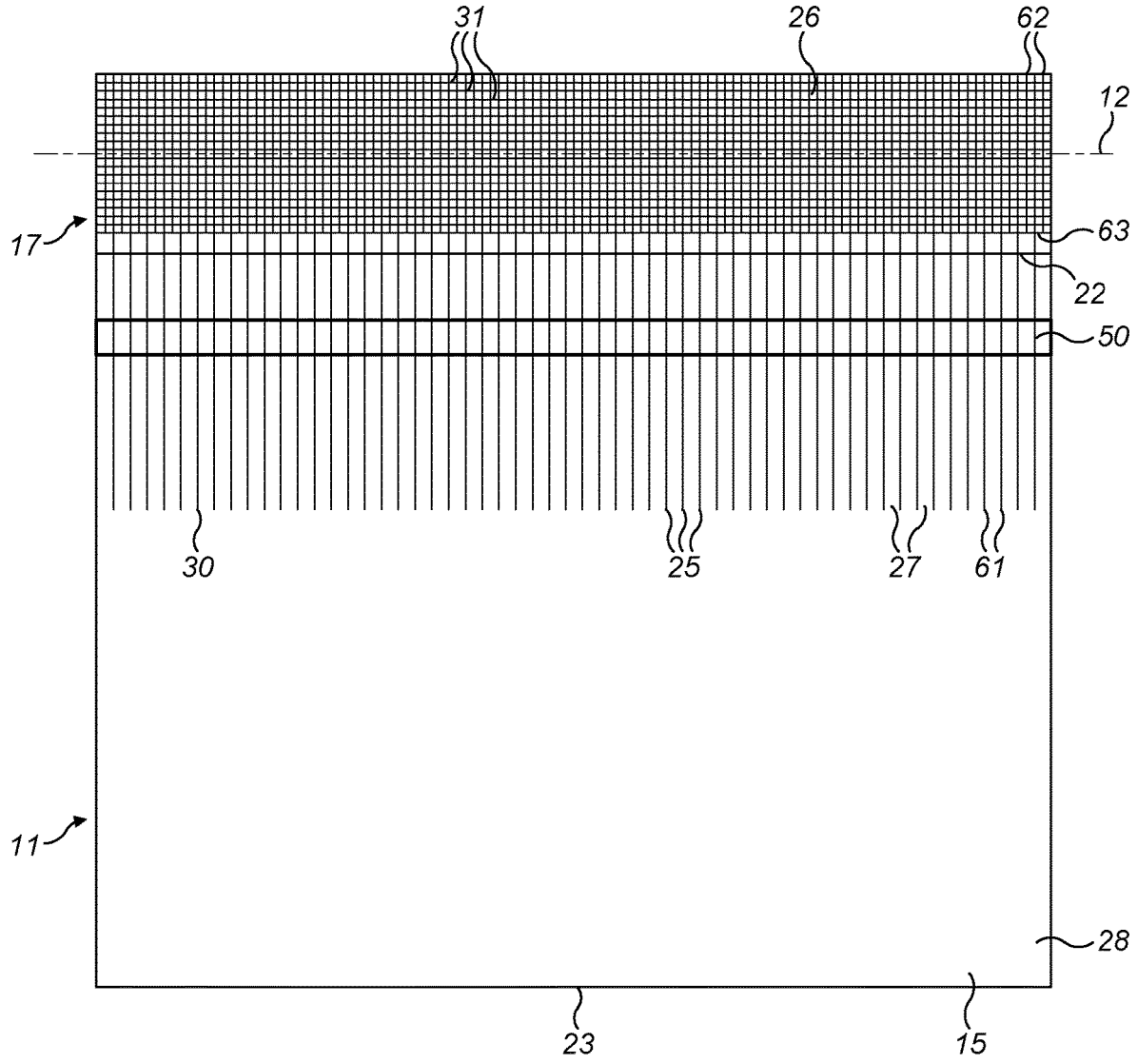
FIG. 18 is a schematic plan view of a further embodiment of a security sheet according to the present invention.
Figure 19:
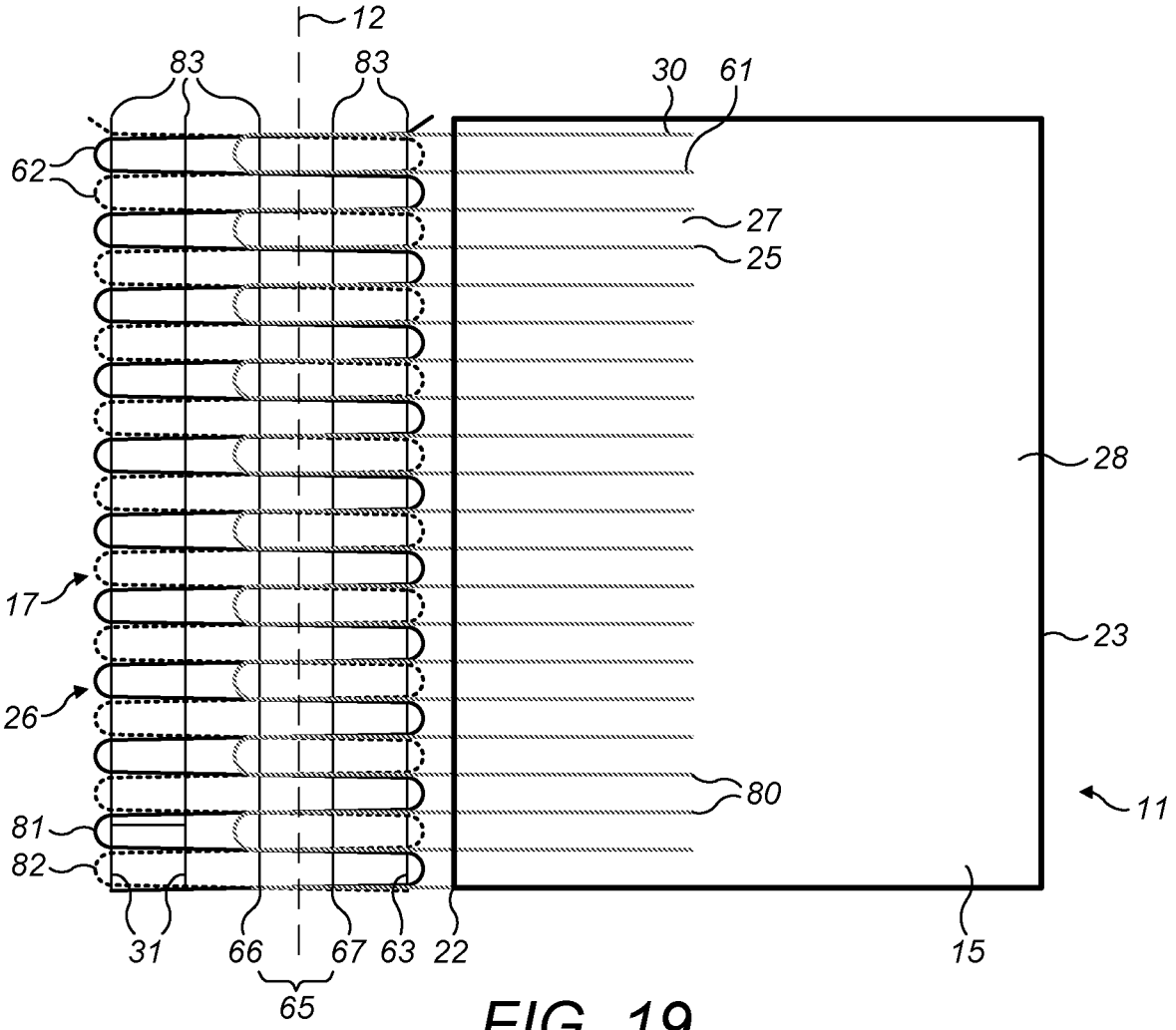
FIG. 19 is a schematic plan view of a further embodiment of a security sheet according to the present invention.

However, the tabs 25 may comprise fewer tab wefts 61 than the wefts 30 of the attachment portion 26 in number and/or per unit area (preferably per unit area on average) as illustrated in FIGS. 18 and 19. In particular, the wefts 30 comprise the tab wefts 61 and infill wefts 62. The tabs 25 comprise at least portions of the tab wefts 61 only and the attachment portion 26 comprises both the infill wefts 62 and tab wefts 61. The tab wefts 61 extend from the warps 31 of the attachment portion 26 and form the tabs 25. The infill wefts 62 do not extend substantially outside of the attachment portion 26 and preferably do not extend into the data sheet 15, such as by extending only between the outer warps 31 of the attachment portion 26 as in FIG. 18. The boundary between the tabs 25 and attachment portion 26 may thus be defined at the ends of the infill wefts 62. At least one infill weft 62 is located between adjacent tab wefts 61 in the attachment portion 26 and at least one infill weft 62 may be located on each side of at least one or each tab weft 61. Hence adjacent tabs 25 may comprise the tab wefts 61 adjacent to or on either side of the at least one infill weft 62. By having fewer tab wefts 61 than wefts 30 of the attachment portion 26 the attachment portion 26 has a higher density of warps 31 and wefts 30 to ensure that a secure stitch can be made through it along the fold line 12. However, the region of the tabs 25 has a lower density of warps 31 and wefts 30 such that there is little increase in the thickness of the data sheet 15. Furthermore a secure connection of the data sheet 15 in the security document 10 is still achieved by reducing the likelihood of the tab wefts 61 overlapping as they are further separated from one another.

The tab wefts 61 extend at least partially across the attachment portion 26. In FIGS. 3, 8 and 16 the tab wefts 61 extend entirely across the attachment portion 26, but as shown in FIG. 19 and discussed further below the tab wefts 61 may extend partially across the attachment portion 26. Alternatively, the tab wefts 61 may be attached to the distal warp 63 such that they substantially do not extend into or form the attachment portion 26 and comprise different wefts 30 to those of the attachment portion 26. In such an embodiment the attachment portion 26 only comprises infill wefts 62.

FIG. 19 illustrates a preferred structure of the attachment layer 17 comprising a textile. FIG. 19 illustrates the attachment layer 17 in an exploded view in order to illustrate its composition, but in practice will be tightly pulled together and may comprise significantly more tabs 25 (e.g. at least twenty or fifty tabs 25 or any other number discussed above). The attachment portion 26 may have a width between its outer warps 31 of at least approximately 8 mm or at least approximately 10 mm and/or optionally up to approximately 30 mm or approximately 20 mm. The attachment portion 26 comprises only five warps 31 in the illustrated embodiment and may comprise five or fewer warps 31, ten or fewer warps 31 or fifteen or fewer warps 31. At least two of the adjacent warps 31 of the attachment portion 26 may be separated from one another (in particular separated in a direction perpendicular to the inner edge 22, attachment line and/or fold line 12) by at least approximately 0.5 mm, at least approximately 1 mm, at least approximately 1.5 mm, at least approximately 2 mm or at least approximately 3 mm.

In FIG. 19 a fold region 65 of the attachment layer 17 extends along and across the fold of the security document 10 (i.e. along the fold line 12) between first and second adjacent regions 66, 67. The fold region 65 is thinner than each of the first and second adjacent regions 66, 67. The attachment layer 17 is foldable about the fold around the inner booklet, which comprises the plurality of leaves 13 and is also foldable about the fold as discussed above. The first and second adjacent regions 66, 67 may each be formed by first and second adjacent warps 66, 67 interlaced with or overlapping wefts 30 of the attachment layer 17 (particularly of the attachment portion 26) and may therefore be thicker than the fold region 65, which may only comprise the wefts 30 extending between the adjacent warps 31. As a result, the fold region 65 and fold line 12 extend along and between the adjacent warps 31 and preferably do not overlap warps 31 of the attachment layer 17 as illustrated. In a similar manner to the separation of the warps 31 discussed above, the fold region 65 is at least approximately 0.5 mm, at least approximately 1 mm, at least approximately 1.5 mm, at least approximately 2mm or at least approximately 3 mm wide across the fold line 12 (preferably entirely along the fold line 12 and/or warps 31) and between the first and second adjacent regions 66, 67. As a result, the fold of the inner booklet (particularly the outermost leaf 13) is adjacent to the fold region 65 and the inner booklet is located in contact with the fold region 65 such that the first and second adjacent regions 66, 67 are located on either side of the fold of the inner booklet. In particular, when the security document 10 is folded closed, the first and second adjacent warps 66, 67 are located on either side of the fold of the inner booklet and the inner booklet is in contact with the wefts 30 between the first and second adjacent regions 66, 67 only at its fold or along its fold line 12.

Figure 20:
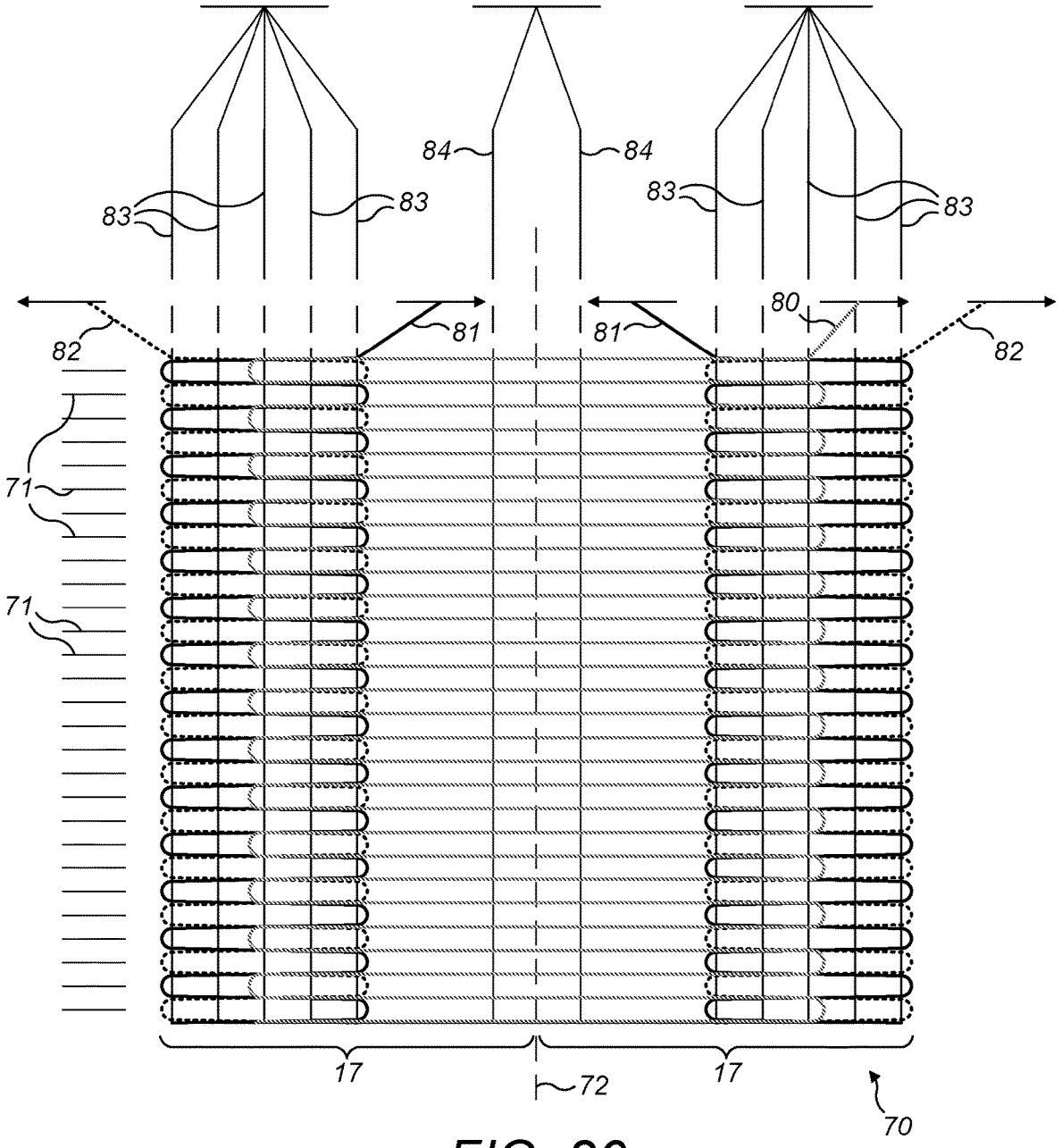
FIG. 20 is a schematic plan view of an attachment layer fabric for forming an attachment layer of the security sheet of FIG. 19.
Figure 21:
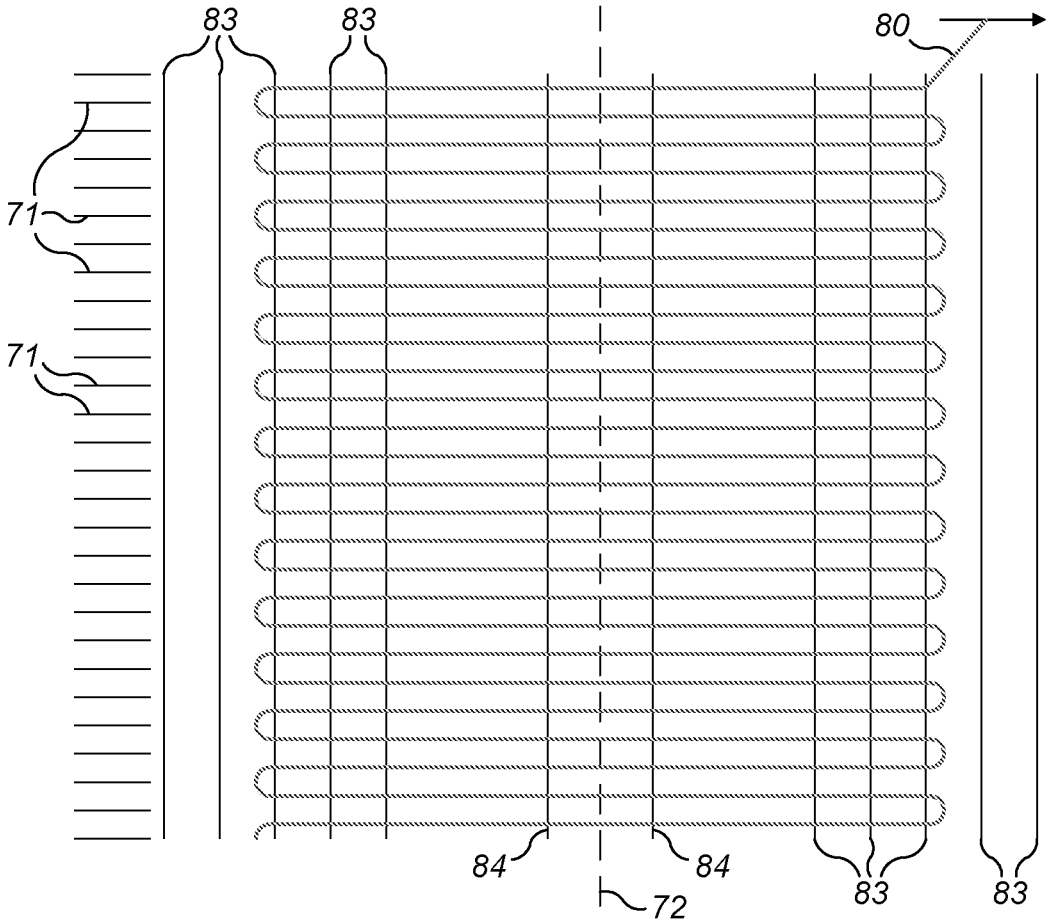
FIGS. 21, 22 and 23 are schematic plan views of weft yarns of the security sheet of FIG. 20.

The attachment portion 26 also comprises at least one yarn 80, 81, 82, 83 extending at least partially through the attachment portion 26 to form the wefts 30 and warps 31. In particular, a plurality of wefts 30 and/or warps 31 may comprise a single continuous yarn 80, 81, 82, 83. FIG. 20 illustrates a method of manufacturing the attachment layer 17 of FIG. 19 and FIGS. 21 to 23 illustrate the yarns 80, 81, 82, 83 used in the method to form the wefts 30 of the attachment layer 17. FIGS. 20 to 23 illustrate the yarns 80, 81, 82, 83 in an exploded configuration and in practice they will be tightly pulled together. FIG. 20 illustrates the formation of an attachment layer fabric 70, which may be cut along a cut line 72 in order to form two attachment layers 17 on either side of the cut line 72 and possibly further attachment layers 17 if cut perpendicular to the illustrated cut line 72. The attachment layer fabric 70 is preferably formed on a machine and the yarns 80, 81, 82, 83, comprising weft yarns 80, 81, 82 for forming the wefts 30 and warp yarns 83 for forming the warps 31, are fed onto the machine. The machine forms loops in the weft yarns 80, 81, 82 at picks 71 and interlaces the weft yarns 80, 81, 82 with the warp yarns 83. Preferably the machine is a knitting machine and more preferably a crochet knitting machine.

The attachment layer 17 and attachment layer fabric 70 comprise a tab weft yarn 80, a first infill weft yarn 81, a second infill weft yarn 82 and at least one warp yarn 83. In particular, a plurality of warp yarns 83 may be fed by the machine into contact with the weft yarns 80, 81, 82 for interlacing therewith. Each separate warp yarn 83 preferably forms a separate warp 31 as illustrated, although a single warp yarn 83 may form a plurality of warps 31.

The tab weft yarn 80 forms the tab wefts 61. The tab weft yarn 80 extends at least partially into the attachment portion 26 and is interlaced with at least one warp yarn 83 or warp 31. The tab weft yarn 80 extends at least partially out of the attachment portion 26 and is not interlaced with itself. The tab weft yarn 80 extends continuously across the attachment layer fabric 70 between the warp yarns 83 of each of the attachment portions 26 and is open looped (i.e. returns or double backs upon itself without crossing) a plurality of times in each attachment portion 26 prior to cutting. After cutting each attachment portion 26 comprises a plurality of tab weft yarns 80, each forming two adjacent tab wefts 61 and a loop within the attachment portion 26 formed from a continuous tab weft yarn 80 therebetween.

The tab weft yarn 80 and tab wefts 61 extend into the attachment portion 26 beyond the attachment or fold line 12 and preferably to the warp 31 beyond the attachment and/or fold line 12. As illustrated, the tab wefts 61 may extend only to the second or third warp 31 inwards from the distal warp 63 (such as when there are ten or fewer or five warps 31). Thus the loop of the tab weft yarn 80 between two tab wefts 61 is located on the opposing side of the attachment and/or fold line 12 to the data sheet 15 and the tab weft yarn 80 loops around at least part of the attachment means securing the security sheet 11 in the security document 10, such as at least one stitch. The tab weft yarn 80 may be interlaced with the or each warp 31 between and including the distal warp 63 and the loop. As a result, the tab wefts 61 are securely held in the attachment portion 26 by both the attachment means and the interlacing with the warps 31. By not extending across the entire attachment portion 26 movement of the attachment layer 17 in the security document 10 is reduced.

Figure 22:
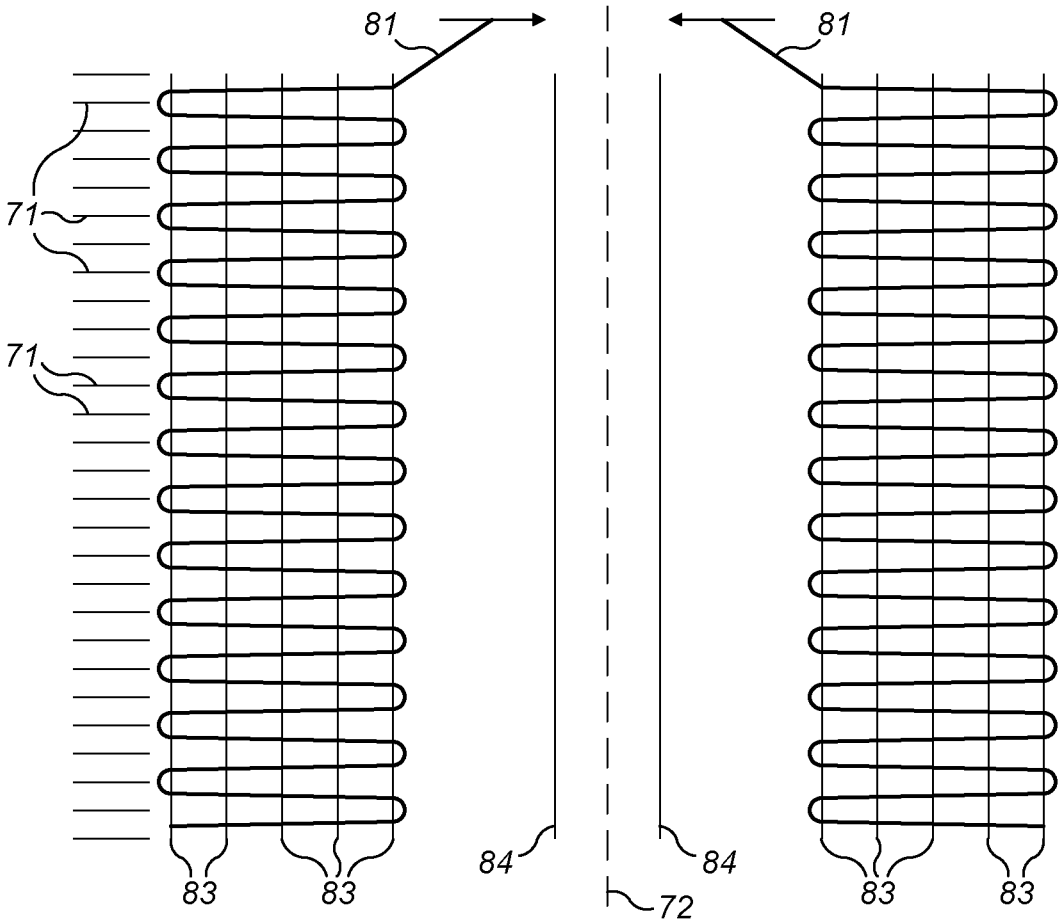
Figure 23:
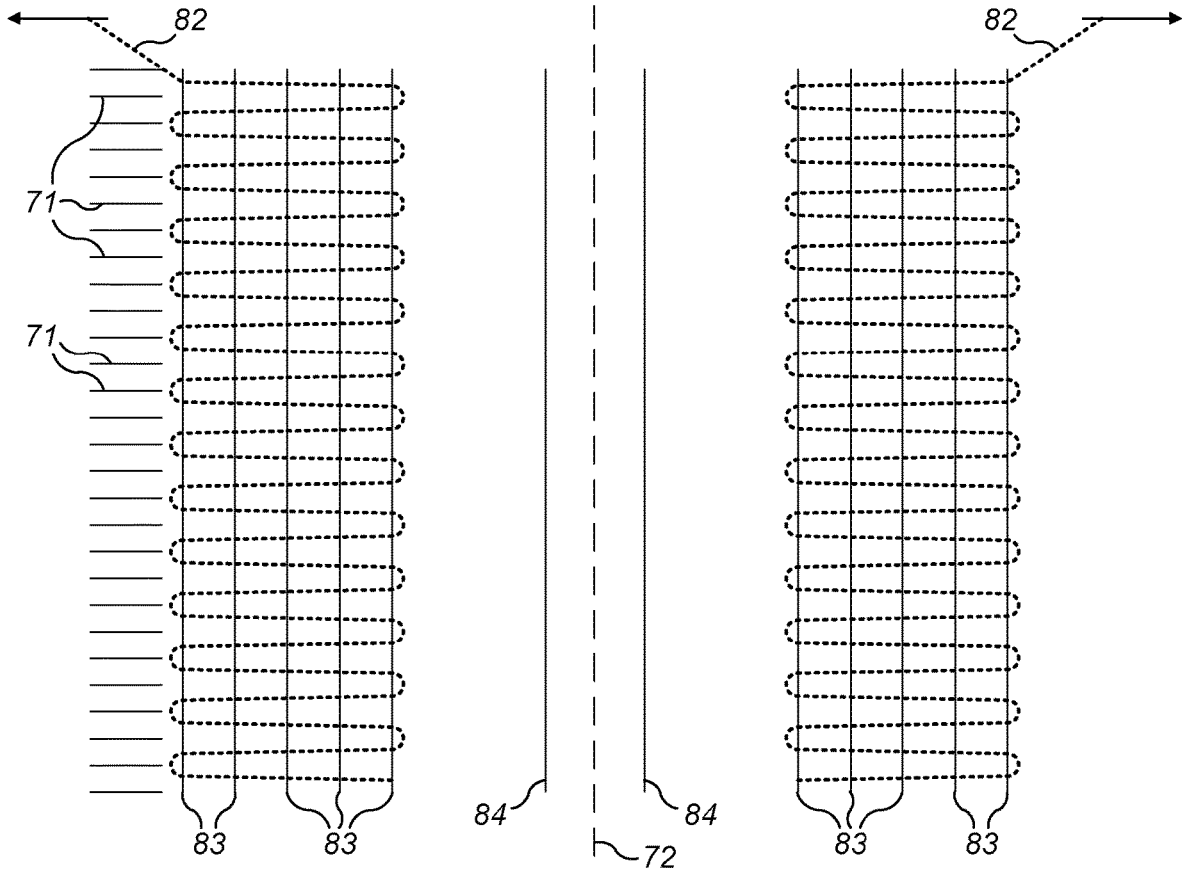

The first and second infill weft yarns 81, 82 continuously form the infill wefts 62 of the attachment portion 26 by looping within the attachment portion 26 between the outer warps 31. As illustrated in FIGS. 20, 22 and 23, the first and second infill weft yarns 81, 82 form open loops at alternate outer warps 31 at each pick 71 such that each loop of the first infill weft yarn 81 is at an opposing outer warp 31 to the corresponding loop of the second infill weft yarn 82.

Figure 24:
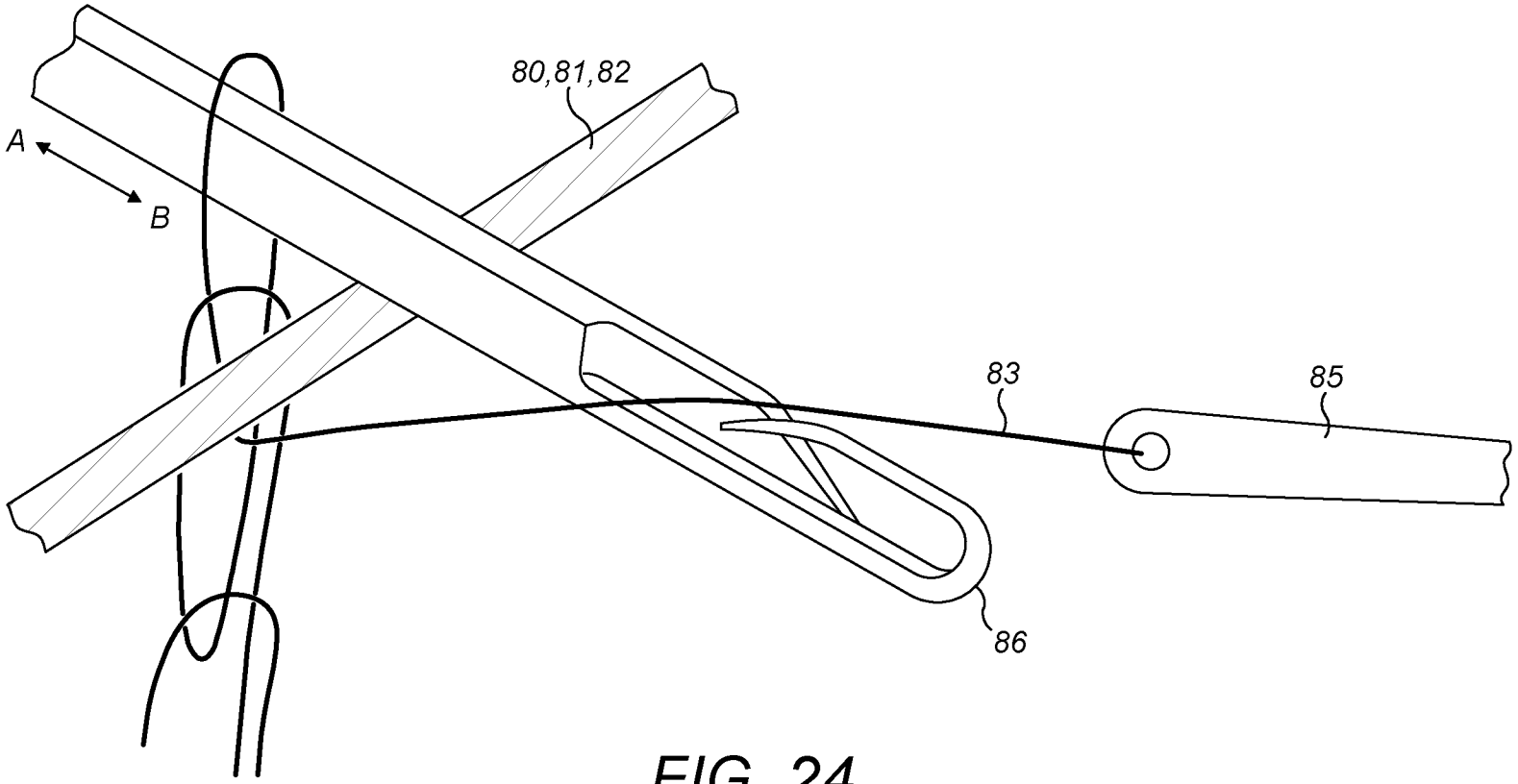
FIG. 24 is an illustration of an interlocking loop between warps and wefts of the security sheet of FIG. 19.

The interlacing between the weft and warp yarns 80, 81, 82, 83 is not shown in FIGS. 19 and 20, but preferably they are interlocked to one another, such as by knitting. In particular, the warp yarns 83 may be knitted into at least one weft yarn 80, 81, 82 such that they are attached to one another by a stitch. In the present disclosure "knitting" refers to forming closed, interlocked loops between yarns. Preferably the knitting is crochet knitting and each interlock comprises a crochet knitting stitch. Using knitting as the interlacing method rather than weaving results in an attachment layer 17 that is harder for a forger to unpick and remove from the security document 10. FIG. 24 illustrates a particularly suitable embodiment in which a warp yarn 83 forms a closed loop around at least one weft yarn 80, 81, 82. In particular, a warp guide 85 feeds the warp yarn 83 into a needle 86, which is preferably a bearded needle 86 as illustrated. The needle 86 overlaps one side of the weft yarn 80, 81, 82 and holds the warp yarn 83 in an open loop about the weft yarn 80, 81, 82 (shown in FIG. 24). The needle 86 moves out of its overlap with the weft yarn 80, 81, 82 in direction A to draw the warp yarn 83 through the loop and form a closed interlocked loop of the warp yarn 83 about the weft yarn 80, 81, 82 (not shown). The needle 86 returns in direction B to form another open loop for interlacing with the adjacent weft yarn 80, 81, 82. Although only one weft yarn 80, 81, 82 is shown in FIG. 24, each weft yarn 80 preferably forms a closed interlocked loop about a plurality of the weft yarns 80, 81, 82 where they overlap as in FIG. 20.

As FIG. 20 further illustrates, the attachment layer fabric 70 may comprise a plurality of holding yarns 84 interlaced with the tab weft yarns 80. As a result, the attachment layers 17 formed after cutting each comprise at least one holding yarn 84 interlaced with the tab wefts 61 and separating the tab wefts 61. The at least one holding yarn 84 may be interlaced with the tab weft yarn 80 by interlocking and/or knitting in a similar manner to the weft and warp yarns 80, 81, 82, 83. The at least one holding yarn 84 is preferably located in the region of the tabs 25 that are eventually attached in the data sheet 15. Preferably the at least one holding yarn 84 is located closer to the ends of the tabs 25 than the warps 31 of the attachment portion 26 to avoid overlap at ends of the tabs 25. The at least one holding yarn 84 may be at least 5 mm from the ends of the tabs 25 to ensure it does not slip off before attachment to the data sheet 15.

Prior to attachment (e.g. by lamination or welding) of the attachment layer 17 in the data sheet 15 and to the at least one body layer 18 the at least one holding yarn 84 is removed from the attachment layer 17. As a result, the at least one holding yarn 84 ensures that the tab weft yarns 80 remain substantially separate during lamination or welding and material of the at least one body layer 18 can pass between them to ensure a strong connection. The at least one holding yarn 84 is removed from the attachment layer 17 by an unwinding mechanism. For example, in a continuous lamination machine a plurality of attachment layers 17 (e.g. one side of the attachment layer fabric 70) may be held around a reel and fed into the laminator with the at least one body layer 18. The at least one holding yarn 84 may be removed via an unwinding mechanism between the reel and laminator. The unwinding mechanism may comprise at least one reel or the like. The unwinding mechanism may also be used in a discontinuous lamination process.

The tab weft yarn 80 preferably comprises a plurality of ends by comprising a plurality of adjacent, substantially parallel, yarns, strips, threads or filaments. In particular, the tab weft yarn 80 may comprise a synthetic yarn, such as nylon, and may comprise a plurality of monofilaments. Preferably the tab weft yarn 80 is substantially clear or transparent in a similar manner to the at least one body layer 18. The first infill weft yarn 81, second infill weft yarn 82 and/or warp yarn 83 may comprise polyester.

The tab weft yarn 80 may have a smaller diameter than the first infill weft yarn 81, second infill weft yarn 82 and/or warp yarn 83 such that the tab wefts 61 have a smaller diameter than the infill wefts 62 and/or warps 31 of the attachment portion 26. As a result, the attachment portion 26 comprises relatively strong yarns to prevent ripping or other damage along the attachment line whilst the tab wefts 61 add little bulk to the data sheet 15 and are therefore more discreet. The tab weft yarn 80 may be less than approximately 150 denier, less than approximately 150 denier and is preferably approximately 80 denier. The first infill weft yarn 81, second infill weft yarn 82 and/or warp yarn 83 may be at least approximately 200 decitex, at least approximately 300 decitex and is preferably approximately 400 decitex.

FIGS. 10 to 15 illustrate further embodiments in which the attachment layer 17 comprises at least one film layer 40. In particular, the attachment portion 26 comprises an elongate body 41 of the at least one film layer 40, which is preferably substantially solid or continuous, and preferably extends parallel to the fold line 12 and inner edge 22 of the data sheet 15. Each tab 25 is comprised of the at least one film layer 40 and extends from the elongate body. The at least one film layer 40 may comprise a plurality of film layers 40 laminated or otherwise bonded together and may comprise at least one of polyamide, polyester, polybutylene terephthalate and polyurethane. The benefit of using at least one film layer 40 is that the tabs 25 can have a variety of different shapes to assist in connecting the attachment layer 17 to the data sheet 15. Furthermore, when the data sheet 15 is viewed in transmitted light by the naked eye, the tabs 25 may have a different opacity to the rest of the data sheet 15 such that they are visible and distinguishable compared to the rest of the data sheet 15 (e.g. as shadows).

As illustrated in FIGS. 10, 11, 12 and 15 at least one or all of the plurality of tabs 25 may taper outwardly away from the attachment portion 26 such that it or they are wider distal to the attachment portion 26 than proximate the attachment portion 26. The tabs 25 therefore provide further resistance to removal from inner edge 22 of the data sheet 15 as they would need to be compressed along their width in order to be removed. Alternatively, at least one or all of the plurality of tabs 25 may taper inwardly away from the attachment portion 26 such that it or they are narrower distal to the attachment portion 26 than proximate the attachment portion 26. Therefore, the spacings 27 are larger within the data sheet 15 and thus provide improved delamination resistance.

Figure 11:
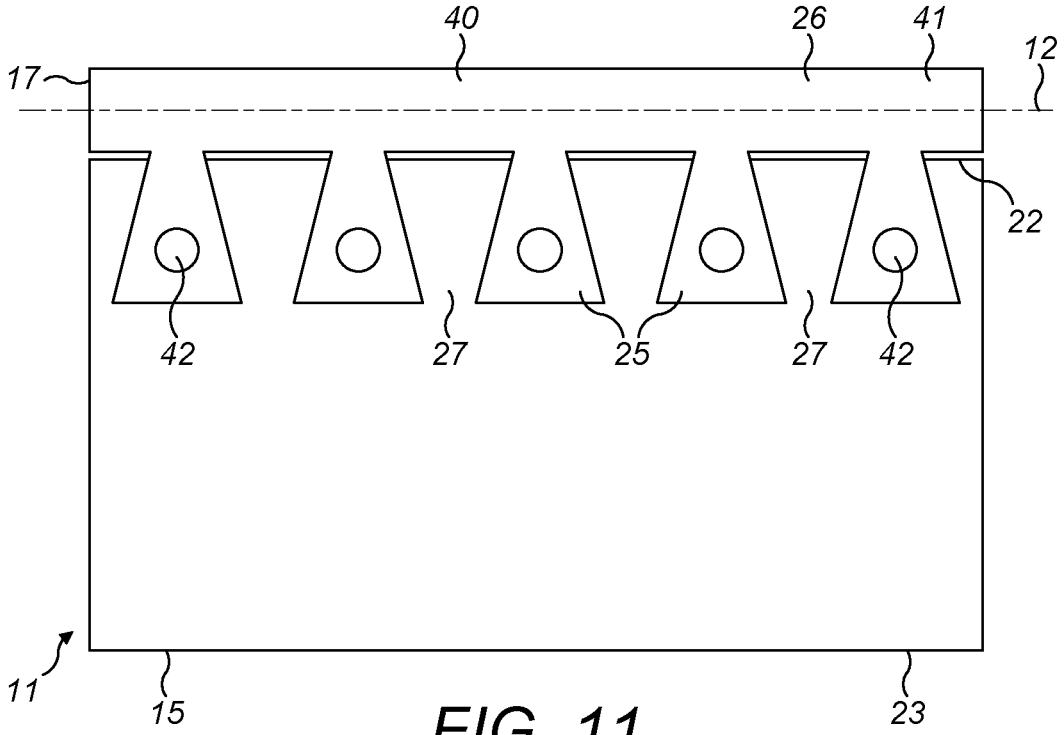
Figure 12:
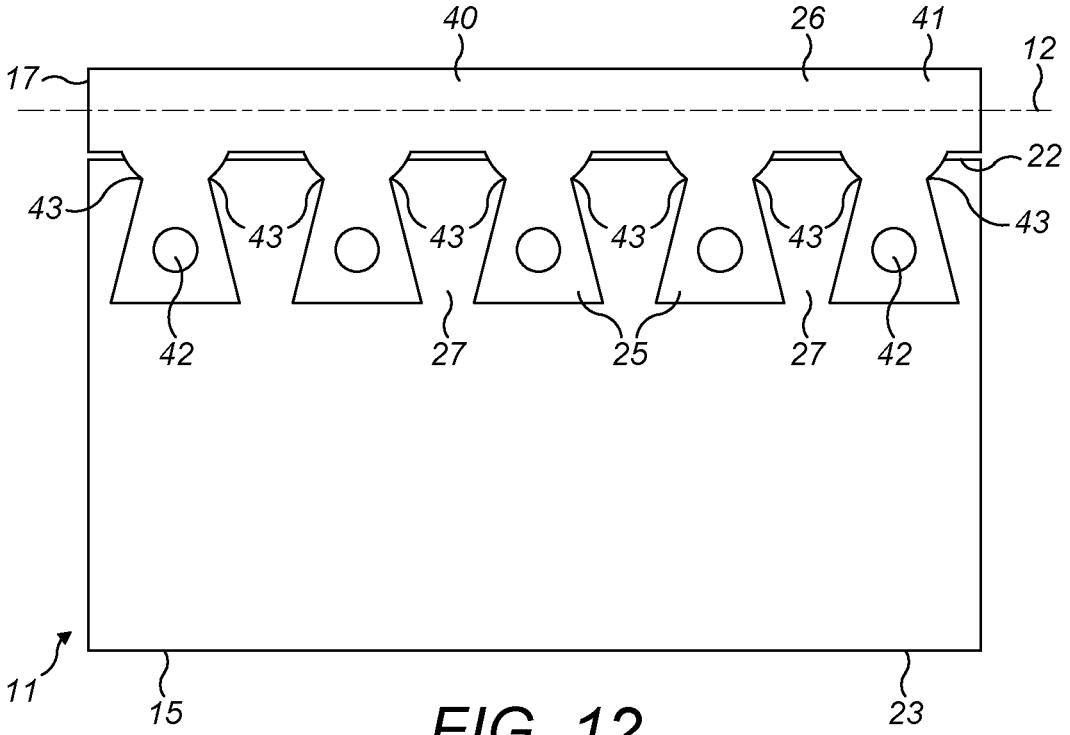

As illustrated in FIGS. 11 and 12, at least one or all of the plurality of tabs 25 may comprise at least one aperture 42. During connection of the attachment layer 17 to the data sheet 15 the material of the data sheet 15 may flow or be bonded or fused through the at least one aperture 42, thereby providing further resistance to the removal of the attachment layer 17 from the data sheet 15.

As illustrated in FIG. 12, at least one or all of the plurality of tabs 25 may comprise at least one indentation 43 on at least one edge. A pair of indentations 43 as illustrated may be located opposite one another on the at least one tab 25 such that the at least one tab 25 has an hourglass shape. Thus the material of the data sheet 15 extends into the at least one indentation 43 to further resist removal of the attachment layer 17.

Figure 13A:
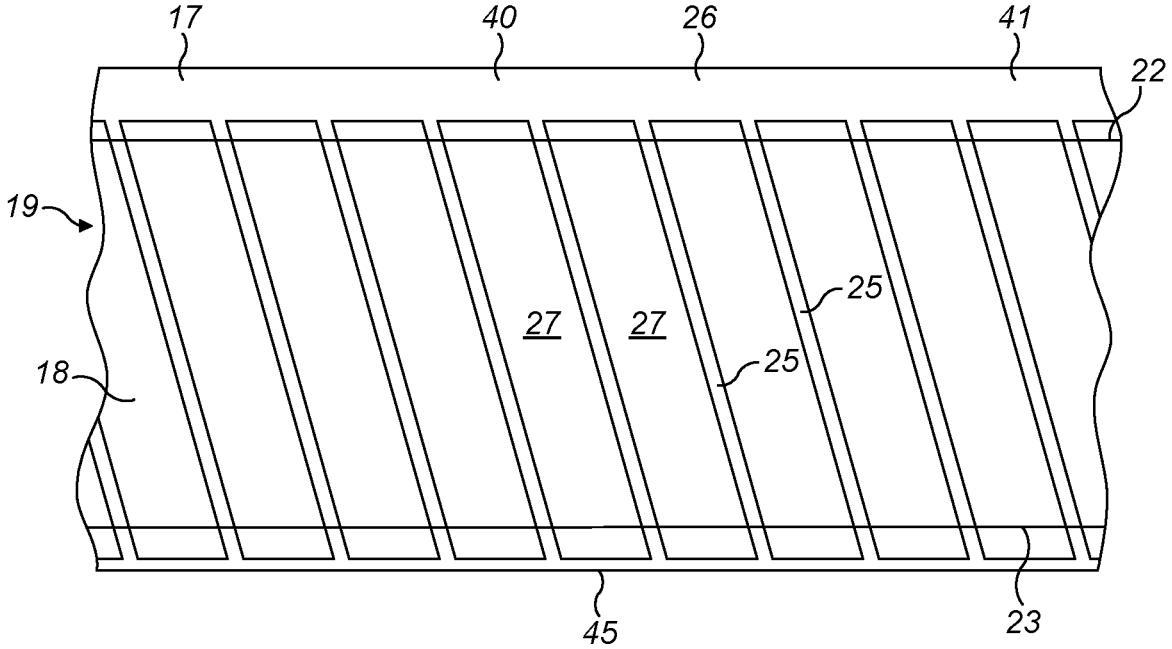
FIG. 13A is a schematic plan view of a laminar structure for forming a plurality of security sheets according to the present invention.
Figure 13B:
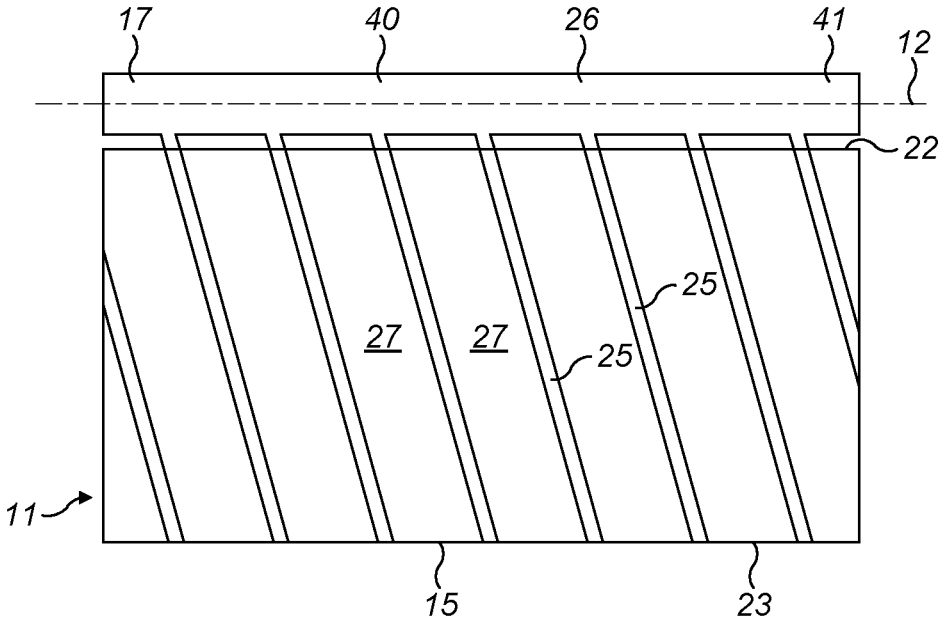
FIG. 13B is a schematic plan view of a security sheet formed from the laminar structure of FIG. 13A.
Figure 14:
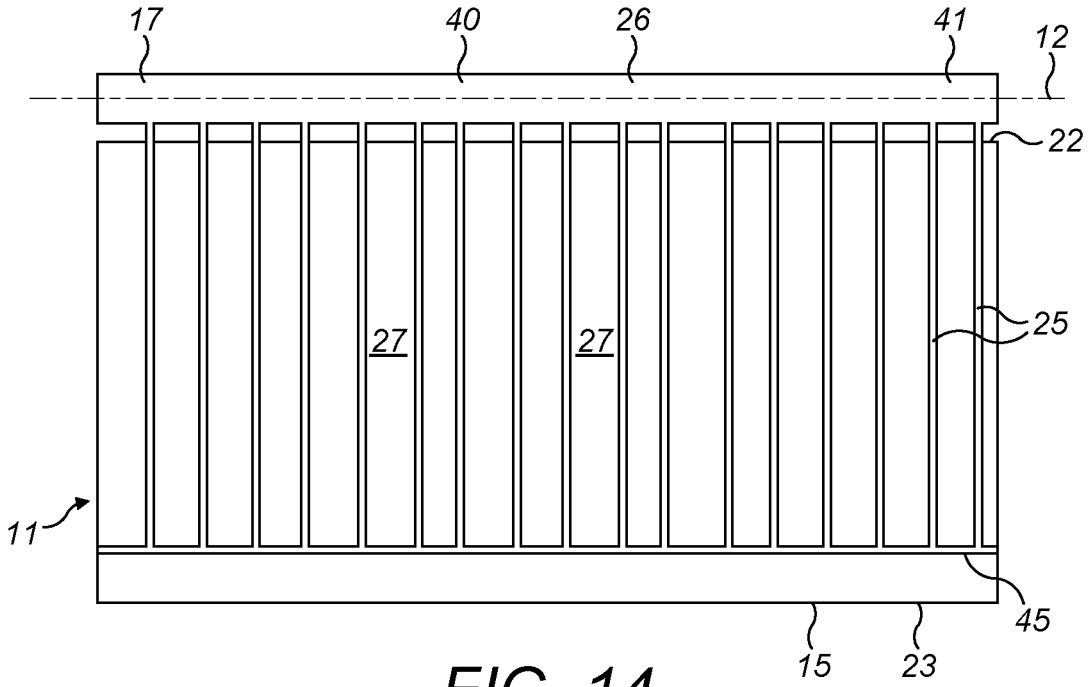
FIGS. 14 and 15 are each schematic plan views of further embodiments of a security sheet according to the present invention.
Figure 15:
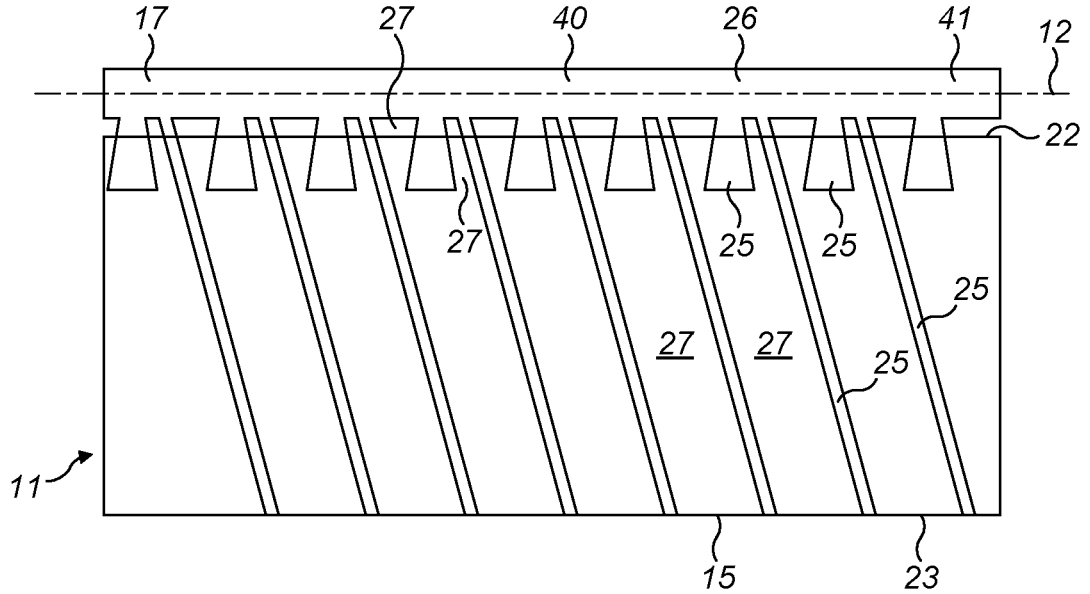

As illustrated in FIGS. 13A to 15, at least one or all of the plurality of tabs 25 may comprise a strip of the at least one film layer 40 extending from the attachment portion 26. Preferably at least one strip extends at an acute angle, such as approximately 45 degrees, to the fold line 12, inner edge 22 of the data sheet 15 and/or sides of the data sheet 15 as shown in FIGS. 13A, 13B and 15 in order to provide further resistance to their removal. Alternatively, at least one strip extends perpendicular to the fold line 12 and/or inner edge 22 of the data sheet 15 and/or parallel to the sides of the data sheet 15 as shown in FIG. 14, which may be simpler to manufacture. The strips are preferably parallel to one another.

The plurality of tabs 25 may comprise free ends distal to the inner edge 22 of, and located within, the data sheet 15, as illustrated in FIGS. 3, 10, 11, 12, 15, 16, 18 and 19. However, the attachment layer 17 may comprise at least one cross support 45 extending across and attached to or formed with at least two tabs 25, and preferably all of the tabs 25, as illustrated in FIGS. 13A, 13B and 14. FIG. 13A shows a laminar structure 19 prior to lamination for forming a plurality of security sheets 11 during a continuous process from at least one elongate body layer 18 and an elongate attachment layer 17, which may be fed from rolls or the like. A cross support 45 is attached at the ends of the tabs 25 distal to the attachment portion 26. At least the cross support 45, in this case also portions of the tabs 25, extends from the outer edge 23 of the at least one body layer 18. The at least one cross support 45 ensures that the tabs 25 do not overlap during manufacture. Once the attachment layer 17 has been located on or between the at least one body layer 18, and preferably after lamination, at least the cross support 45, and in this case also portions of the tabs 25 extending from the data sheet 15, is cut from the attachment layer 17. FIG. 13B shows the subsequently formed security sheet 11 in which the data sheet 15 and attachment layer 17 have also been cut from the laminar structure 19 of FIG. 13A. As in FIG. 14 the at least one cross support 45 may be located within the data sheet 15 such that cutting is not required.

The at least one cross support 45 may have any suitable form, such as a strip as in FIGS. 13A and 14 and may be formed by the punching of the at least one spacing 27 from the at least one film layer 40. Alternatively the at least one cross support 45 may comprise at least one warp 31 of a textile (or at least one weft of a textile, depending upon orientation and nomenclature of the attachment layer 17). In particular, if the attachment layer 17 comprises a textile as discussed above the at least one cross support 45 extends between at least two adjacent tab wefts 61 within the data sheet 15 and the at least one cross support 45 comprises at least one warp 31 of the warps 31 of the textile. However, the at least one cross support 45 comprises fewer warps 31 than the attachment portion 26 in number and/or per unit area (preferably per unit area on average). In particular, at least two adjacent tabs 25 are separated by the at least one spacing 27 and the at least one spacing 27 separates the at least one cross support 45 and the attachment portion 26, and/or adjacent cross supports 45, by a distance greater than the average distance between warps 31 of the attachment portion 26.

Further alternatively, the at least one cross support 45 may comprise a tape or strip of at least one film layer 40 extending across, above and/or below, the tabs 25 and bonded thereto, such as by lamination, welding or adhesive, the warps or wefts. However, at least one spacing 27, which may be considered to extend between two adjacent tabs 25 from the attachment portion 26 to the at least one cross support 45, is still preferably suitably large to allow a high volume of material of the data sheet 15 to flow through it. In general, including embodiments with at least one cross support 45, the at least one spacing 27, and preferably all of the spacings 27, may extend between adjacent tabs 25 across at least 5%, more preferably across at least 10%, more preferably across at least 25%, more preferably across at least 50%, more preferably across at least 75% and yet more preferably at least 90% of the distance from the inner edge 22 of the data sheet 15 to the outer edge 23 of the data sheet 15 and between the tabs 25.

FIGS. 16, 17A, 17B and 18 illustrate a further embodiment, which is similar to FIGS. 6A to 7B, wherein at least one patch 50, 51 is applied or located over at least a portion of the tabs 25 (i.e. on the opposing side of the tabs 25 to the at least one body layer 18) and attached to or embedded within the data sheet 15. Although not shown, at least one patch 50, 51 may also be applied in the embodiment of FIG. 19. The at least one patch 50, 51 assists in further securing the tabs 25 in the first or second outer surface 28, 29 of the data sheet 15. As shown, at least one patch 50 may comprise an elongate band or strip extending between the sides of the data sheet 15 across all of the tabs 25. At least one patch 51, in this case two patches 51, may comprise a band extending across a portion of the data sheet 15 and across several, but not all, of the tabs 25. As shown the at least one patch 50, 51 may only cover a portion of the length of the tabs 25. Alternatively, the at least one patch 50, 51 may extend across all of the length of the tabs 25 and cover substantially all of the tabs 25 located at the first or second outer surface 28, 29.

The at least one patch 50, 51 may be applied over at least a portion of the tabs 25 prior to lamination and laminated together with the tabs 25 and at least one body layer 18. As a result, the at least one patch 50, 51 may sink into the at least one body layer 18 and around the tabs 25 such that it is substantially indistinguishable from the at least one body layer 18. Alternatively, the tabs 25 and at least one body layer 18 are laminated together and the at least on patch 50, 51 subsequently applied over at least a portion of the tabs 25 and attached in a further step. Preferably the further step is welding (e.g. ultrasonically) the tabs 25 to the first or second outer surface 28, 29, although may comprise further lamination or the like. As a result, the at least one patch 50, 51 may be visible at the first or second outer surface 28, 29 as a ridge or protrusion (as shown in FIG. 17B).

The attachment portion 26 and tabs 25 may be formed from any combination of the arrangements disclosed herein. For example, as in FIG. 15, some tabs 25 may comprise strips and some tabs 25 may taper outwardly. In further embodiments at least one tab 25 comprises at least one barb configured to resist outward movement of the attachment layer 17, preferably by the at least one bard embedding itself in the data sheet 15 during an attempted removal. The attachment portion 26 may comprise a nonwoven textile and each tab 25 may comprise a strip of warps and wefts of the nonwoven textile or a single weft of the nonwoven textile. At least one tab 25 may extend in to the data sheet 15 the shape of a spiral, symbol, logo or the like.

The tabs 25 may extend across the data sheet 15 by the same (as illustrated) or different distances. For example, the ends of the tabs 25 distal to the inner edge 22 may form a sinusoidal path or the like. The ends of the tabs 25 may form patterns visible to the naked eye in the data sheet 15 in reflected and/or transmitted light incident thereupon.

The attachment layer 17 may also comprise the textile discussed above embedded in at least one film layer. For example, the attachment portion 26 may be at least partially embedded in at least one film layer. The at least one film layer may extend from the textile of the attachment portion 26 into the body layers 18 and may be laminated with the body layers 18 to form the security sheet 11.

Furthermore, in the embodiments in which the attachment layer 17 extends across the entire data sheet 15, such as in FIGS. 4A, 7A, 8 and 15, prior to lamination of the at least one body layer 18 the tabs 25 may extend beyond the outer edge 23 in a similar manner to that shown in FIG. 13A. Prior to or after lamination the excess portions of the tabs 25 are cut away. However, cutting the tabs 25 at the edges of the data sheet 15 may result in them being exposed at the edges, thereby forming discrete boundaries at which a sharp implement can be inserted by a counterfeiter to attempt delamination. As a result, in preferred embodiments, the tabs 25 exposed at the edges of the data sheet 15 are sealed to the data sheet 15. The sealing may be achieved by lamination or welding directly onto the edges such that material of the data sheet 15 flows over the exposed tabs 25. Alternatively, additional portions of the same material as the data sheet 15 may be located adjacent to at least one edge of the at least one body layer 18 and laminated thereto during the main lamination of the laminar structure 19.

At least some tabs 25 may be attached at the first outer surface 28, at least some tabs 25 may be attached at the second outer surface 29 and/or at least some tabs 25 may be attached within the thickness of the data sheet 15 (i.e. combinations of the arrangements of FIGS. 4A to 7B).

The tabs 25 may be attached to the first or second outer surface 28, 29 by adhesion. For example, the tabs 25 may be located on the first or second outer surface 28, 29 and an adhesive applied to them. The adhesive may comprise a solution or a film (comprising, for example, polyurethane) that fuses through the tabs 25 and with the data sheet 15.

In the illustrated embodiments the attachment portion 26 is entirely located outside of the data sheet 15. Such an arrangement is preferred as it reduces the size of the discrete boundary between the attachment layer 17 and data sheet 15 at the inner edge 22 such that delamination is less likely. However, the tabs 25 need to be particularly resistant to tearing along the inner edge 22 in such an arrangement, although it has been found that the aforementioned embodiments are sufficient in the case of a passport. In order to further improve resistance to tearing along the inner edge 22 the attachment portion 26 may extend partly into the data sheet 15, such as by being located between or on at least one body layer 18. For example, the attachment portion 26 may extend into the data sheet 15 up to 25%, more preferably up to 10% and more preferably up to 5% of the distance from the inner edge 22 to the outer edge 23 of the data sheet 15.

The attachment layer 17 may comprise at least one security feature located in or on the attachment portion 26 and/or at least one tab 25 or bridging the attachment portion 26 and the tabs 25 so it runs from one section into the other. Such security features may comprise, for example, laser marking, printed ink, holograms, security fibres, security planchettes, security threads, holograms and the like. The tabs 25 and/or attachment portion 26 may comprise a material with inherent security properties, such as by being formed from a polymer and/or with a fluorescent, phosphorescent, photochromic, thermochromic or the like additive. The tabs 25 and/or attachment portion 26 may be metallised and/or comprise features formed by demetallisation.

In the illustrated embodiment the attachment layer 17 is attached to a single data sheet 15 and extends only partially from the fold line 12 into the side of the security document 10 opposing the data sheet 15. In other embodiments a second data sheet 15 is attached to the opposing end of the attachment layer 17, in a similar manner or different manner to that disclosed herein. The attachment layer 17 may also extend across the entire side of the security document 10 opposite to the data sheet 15.

The data sheet 15 may comprise further security features in addition to the data 16. For example, the data sheet 15 may comprise an RFID chip and/or antenna, laser marking, printed ink, holograms, security fibres, security planchettes, security threads, holograms and the like. One or more of the body layers 18 may be at least partially transparent and/or opaque. In particular, at least part of the tabs 25 extending into the data sheet 15 may be hidden from view to the human eye in reflected and/or transmitted light incident upon the first and/or second outer surface 28, 29.

The invention claimed is:

1. A security sheet comprising:

a data sheet for displaying data; and an attachment layer comprising a plurality of tabs and an attachment portion, wherein the plurality of tabs extend from the attachment portion for attaching the data sheet into a security document, wherein:

the plurality of tabs are attached to the data sheet such that the attachment layer is attached to and extends from the data sheet, the plurality of tabs are attached to the data sheet by being at least partially embedded in the data sheet, and at least one spacing separates at least two adjacent tabs of the plurality of tabs and the plurality of tabs are at least partially embedded in the data sheet by material of the data sheet at least partially filling the at least one spacing.

2. The security sheet of claim 1, wherein the security sheet comprises data elements in or on the data sheet and the plurality of tabs at least partially overlap the data elements.

3. The security sheet of claim 1, wherein the data sheet is formed from at least a plurality of body layers and at least one tab of the plurality of tabs is attached between two adjacent body layers attached to one another.

4. The security sheet of claim 1, wherein the data sheet is formed from at least one body layer and at least one tab of the plurality of tabs is attached at or adjacent to and at least partially overlies an outer surface of at least one body layer and the data sheet.

5. The security sheet of claim 4 further comprising at least one patch located over at least a portion of the plurality of tabs and attached to the data sheet.

6. The security sheet of claim 1, wherein the attachment layer comprises a textile and/or at least one film layer.

7. The security sheet of claim 6, wherein the attachment layer comprises a textile and the attachment portion comprises a plurality of warps intersecting a plurality of wefts and the plurality of tabs comprises portions of the plurality of wefts extending from the plurality of warps.

8. The security sheet of claim 6, wherein the attachment layer comprises a textile comprising warps and wefts and the attachment portion comprises at least two of the warps of the textile interlacing and/or overlapping at least portions of at least two of the wefts of the textile.

9. The security sheet of claim 8, wherein the wefts comprise tab wefts and the plurality of tabs comprise at least portions of the tab wefts.

10. The security sheet of claim 9, wherein the plurality of tabs comprise fewer tab wefts than the wefts of the attachment portion.

11. The security sheet of claim 9, wherein at least one tab weft extends at least partially across the attachment portion.

12. The security sheet of claim 11, wherein the wefts of the textile further comprise at least one infill weft, wherein the attachment portion comprises the at least one infill weft between at least two tab wefts and at least two adjacent tabs comprise the at least two tab wefts.

13. The security sheet of claim 12, wherein the tab wefts have a smaller diameter than at least one infill weft and/or warps of the attachment portion.

14. The security sheet of claim 8, wherein the attachment portion comprises the warps intersecting the wefts and the plurality of tabs comprise portions of the wefts extending from the warps.

15. The security sheet of claim 8, wherein a continuous yarn forms a plurality of the wefts.

16. The security sheet of claim 8, wherein at least one warp of the attachment portion is interlaced with at least one weft of the attachment portion by at least one interlocking loop of the at least one warp and/or the at least one weft.

17. The security sheet of claim 1, wherein at least two adjacent tabs of the plurality of tabs are separated by at least one spacing and are attached to one another within data sheet by at least one cross support, the at least one spacing substantially separating the at least one cross support and attachment portion.

18. A laminar structure for forming a security sheet, the laminar structure comprising:

at least one body layer for forming a data sheet for displaying data; and an attachment layer comprising a plurality of tabs and an attachment portion, wherein the plurality of tabs extend from the attachment portion for attaching the data sheet into a security document, wherein:

the plurality of tabs at least partially overlap the at least one body layer such that the attachment layer extends from the at least one body layer;

the plurality of tabs are attached to the at least one body layer by being at least partially embedded in the at least one body layer; and at least one spacing separates at least two adjacent tabs of the plurality of tabs and the plurality of tabs are at least partially embedded in the at least one body layer by material of the at least one body layer at least partially filling the at least one spacing.

19. A method of forming a security sheet comprising:

locating an attachment layer to overlap at least one body layer, wherein the at least one body layer is for forming a data sheet for displaying data, wherein the attachment layer comprises a plurality of tabs and an attachment portion, wherein the plurality of tabs extend from the attachment portion for attaching a data sheet into a security document; and attaching the plurality of tabs to the at least one body layer such that:

the attachment layer is attached to and extends from the at least one body layer and the at least one body layer forms the data sheet;

the plurality of tabs are attached to the data sheet by being at least partially embedded in the data sheet; and at least one spacing separates at least two adjacent tabs of the plurality of tabs and the plurality of tabs are at least partially embedded in the data sheet by material of the data sheet at least partially filling the at least one spacing.

20. The method of claim 19, wherein the method comprises forming the attachment layer, wherein forming the attachment layer comprises:

providing a textile comprising warps and wefts, wherein the plurality of tabs comprises at least portions of tab wefts of the wefts of the textile and at least one holding yarn is interlaced with at least one tab weft; and removing the at least one holding yarn prior to the attachment step.

* * * * *